US011735000B2

(12) United States Patent
Colvin et al.

(10) Patent No.: US 11,735,000 B2
(45) Date of Patent: Aug. 22, 2023

(54) ELECTRONIC GAMING MACHINE WITH DIGITAL BUTTON DECK DEVICE INCORPORATING PLAYER TRACKING CAPABILITIES

(71) Applicant: Gaming Arts, LLC, Las Vegas, NV (US)

(72) Inventors: David Colvin, Las Vegas, NV (US); Eric D. Colvin, Las Vegas, NV (US); Moises Navarrete, Las Vegas, NV (US)

(73) Assignee: Gaming Arts, LLC, Las Vegas, NV (US)

( * ) Notice: Subject to any disclaimer, the term of this patent is extended or adjusted under 35 U.S.C. 154(b) by 0 days.

(21) Appl. No.: 17/647,146

(22) Filed: Jan. 5, 2022

(65) Prior Publication Data

US 2022/0270440 A1 Aug. 25, 2022

Related U.S. Application Data

(63) Continuation of application No. 16/794,126, filed on Feb. 18, 2020, now Pat. No. 11,227,465.

(51) Int. Cl.
*G07F 17/32* (2006.01)

(52) U.S. Cl.
CPC ..... *G07F 17/3239* (2013.01); *G07F 17/3206* (2013.01); *G07F 17/3209* (2013.01); *G07F 17/3255* (2013.01)

(58) Field of Classification Search
CPC ..... G07F 17/3202; G07F 17/3204; G07F 17/3309; G07F 17/3211; G07F 17/3213
See application file for complete search history.

(56) References Cited

U.S. PATENT DOCUMENTS

| | | | | |
|---|---|---|---|---|
| 8,096,884 | B2 * | 1/2012 | Beadell | G07F 17/3209 463/46 |
| 2005/0049043 | A1 * | 3/2005 | Crivelli | G07F 17/32 463/29 |
| 2005/0113163 | A1 * | 5/2005 | Mattice | G07F 17/32 463/16 |
| 2007/0265054 | A1 * | 11/2007 | Walker | G07F 17/3244 463/16 |
| 2014/0364199 | A1 * | 12/2014 | Baerlocher | G07F 17/3244 463/25 |
| 2018/0197374 | A1 * | 7/2018 | Johnson | G06Q 20/18 |

* cited by examiner

*Primary Examiner* — James S. McClellan
(74) *Attorney, Agent, or Firm* — FisherBroyles, LLP; Rob L. Phillips

(57) ABSTRACT

System and methods for providing a digital touch screen button display device incorporating player tracking and player rewards capabilities for an electronic gaming machine including game play functionality via a touch screen LCD thereby eliminating the need for a separate player tracking module. The digital button display device is located on the button deck of an electronic gaming machine and cooperates and communicates with the slot accounting system of a casino and may contain one or more interoperability modules to cooperate and communicate with differing slot accounting systems.

82 Claims, 11 Drawing Sheets

ELECTRONIC GAMING MACHINE WITH DIGITAL BUTTON DECK DEVICE INCORPORATING PLAYER TRACKING CAPABILITIES

CROSS-REFERENCE

This application claims priority to U.S. patent application Ser. No. 16/794,126 filed Feb. 18, 2020 which claims priority to U.S. Patent Application No. 62/954,115 filed Dec. 27, 2019 both of which are incorporated herein for all purposes.

FIELD OF THE INVENTION

The embodiments of the present invention relate to systems and methods for providing electronic gaming machines (EGMs) with a digital button display device incorporating player tracking capabilities.

BACKGROUND

Casinos derive much of their gaming revenue from electronic gaming machines ("EGMs"), also known as slot machines. Over the years, EGMs have evolved to include new technologies such as dual or triple landscape oriented game displays, LCD slot toppers, large portrait oriented displays, curved portrait oriented displays, J-curve portrait oriented displays, reverse J-curve portrait oriented displays, S-curve portrait mounted displays, EGM signage, and button decks including touch screen LCD displays, etc. While such technological advances enhance game play and player appeal, secondary issues may arise which limit such advances from both functional and technical standpoints and add significant cost for manufacturing the EGM. Secondary issues may include over taxing processing power and graphics card capabilities due to adding additional displays, 4K displays, etc., which also raise manufacturing costs. High or increased height peripheral decks for mounting, bill validators, printers, player tracking modules, card readers, speakers, etc., may also create issues. Such high or increased height peripheral decks may limit the size, whether horizontally or vertically of player tracking module (PTM) displays which may limit the PTM functionality and utility. For instance, a 6.2" display with a resolution of 640×240 pixels limits the amount of information that can be displayed to the player and, due to other components mounted on the peripheral deck, cannot reasonably be made larger.

Larger portrait mount displays, such as 49" or 55" displays, while seemingly more engaging for a player, may change the player viewing angle from approximately −5° to 25° or higher, relative to horizontal, as the center of game play activity resides higher on the EGM's large height displays relative to the seated height of the player and further elevated to allow for the height of the peripheral deck. Such changes in viewing angles can cause minor to moderate or even more severe orthopedic complications for players, especially those with preexisting orthopedic conditions or older players as the player's head may be continually forced to look up or remain cocked as opposed to the player effectively looking straight ahead or horizontally, which is a more convenient and normal viewing angle. Accordingly, reducing the height of these larger primary game monitors, relative to the player angle of vision, is a positive advance for many players.

The embodiments of the electronic gaming machine digital button display device incorporating player tracking capabilities and methods detailed herein addresses many of the problems associated with the manufacture and use of EGMs. Prior art includes removing the PTM and incorporating its functionality into the main game screen using picture-in-picture technology. While this does address some of the aforementioned problems, other problems are created. Game studios may spend thousands of manhours of engineering and art creation time to produce a game and often virtually almost every pixel (known as pixel perfect) forms the basis for a successful graphic presentation. Any deviation from the original game design and appearance may adversely affect the game performance or win per unit. This use of picture-in-picture technology effectively squeezes the game display portion horizontally or vertically and may disrupt the intended game screen images in order to allow for the room necessary to display the player tracking and player services functionality. For instance, a typical monitor resolution may be 1920×1080 pixels where normally the actual game display takes over the entire screen. Squeezing the image to 1540×1080 horizontally or 1920×860 vertically, greatly distorts the original game images. As an example, a circular symbol will appear significantly elliptical and game characters will look excessively thin and unnatural. Similarly, placing the player tracking display within a rectangular area on the game screen almost always covers game content which is important for the game to be successful. Such distortion of the game display is highly disruptive to the player and adds graphic complexity which can cause the player to focus on areas not involved in actual game play and thus possibly lose interest in a particular game. Such prior art may be implemented on a game-by-game basis or floor wide in a casino and often requires the use of additional hardware on each EGM at a very significant cost to the manufacturer or the casino, depending on implementation.

Moreover, casinos utilizing picture-in-picture technology continue to have the EGMs on their floors with high peripheral decks as manufacturers do not make special machines without the room necessary to mount PTMs which most continue to use. Accordingly, machines that exist in this environment often have blank plates where the PTM would otherwise reside resulting in the same peripheral deck height.

SUMMARY

The embodiments of the present invention relate to an electronic gaming machine digital button display device incorporating player tracking capabilities. The systems and methods herein provide a single display and combined hardware, where applicable, to accommodate both player reward capabilities and a touch screen LCD button deck, necessary for game play, which communicates and cooperates with a casino's slot accounting system (SAS) and/or player tracking system (PTS). Those skilled in the art will recognize that although LCD displays are discussed in detail, Other display types such as IPS-LCD (In-Plane Switching Liquid Crystal Display), OLED (Organic Light-Emitting Diode), AMOLED (Active-Matrix Organic Light-Emitting Diode), or other display types may be utilized with the present invention.

One skilled in the art will recognize that certain types of EGMs, generally utilized in regulated casino environments, are still commonly referred to as "slot machines." Although the etymology of the term "slot machine" was originally derived from a coin slot in the gaming machines at the time, coin slots have long since generally been replaced by payment input devices or bill validators which only accept paper currency or ticket-in-ticket-out vouchers and/or electronic fund transfer means, such as card readers, mobile device payment means, account interfaces, etc., yet EGMs are still commonly referred to as slot machines. As a result, the term EGM and slot machine are used interchangeably and are defined to mean an electronic gaming machine entirely different than a laptop or desktop computer, cell phones, tablet computer gaming devices and the like. Moreover, EGMs may encompass not only fully electronic gaming machines such as video reel, keno, bingo, poker machines etc., but also include partially mechanical devices coupled with electronic displays or similar combining to form an electromechanical machine.

As the EGM industry evolves, many manufacturers increasingly utilize video-based displays as opposed to electromechanical type slot machines and the like, yet the demand for both mechanical and electronic EGMs remains strong in most markets. The embodiments of the present invention adapt to any electronic or electromechanical gaming machine which utilize touch screen LCD button deck and include player tracking modules which cooperate with and communicate with player tracking systems and/or slot accounting systems. One skilled in the art will recognize that even though touch screen LCD button decks are commonplace, additional buttons often reside on the button deck and may be of mechanical, electromechanical, electronic, separate touch screen LCD, or similar design and construction.

An object of the embodiments of the present invention is to add player tracking and player reward capabilities to the EGM's touch screen button deck, thereby providing many benefits, such as decreased peripheral deck height, enhanced operability for player tracking and player reward functions by significantly increasing the size of the player tracking and player reward display, and reducing the total number of displays on an EGM thereby reducing processing and video card demands along with reducing the overall cost of manufacturing the EGM. Moreover, embodiments of the present invention adding player tracking and player reward capabilities to the EGM's touch screen button deck allows for even further reductions of height of the peripheral deck and thus the height of the game display and EGM itself, when other peripherals are added to the button deck. For instance, moving the printer, card reader, and bill acceptor to the button deck or the approximate intersection of the button deck and peripheral deck, allows for a further decrease in the peripheral deck and if the speakers are relocated to the button deck or another area of the EGM, the partial or complete elimination of the peripheral deck itself is possible.

Another object of the embodiments of the present invention is to provide for a significantly different assembly package relative to current player tracking modules or LCD button displays. PTMs are generally mounted on the peripheral deck either approximately vertically or at an angle up to approximately 45° from vertical. Those skilled in the art will recognize that the terms approximate, approximately, about, or similar terms, when describing angles or measurements, are not intended to represent exact numbers or limit the scope as additional variations and modifications exist within the scope and spirit of the invention as described. Instead they are intended as guidelines where the range may be plus or minus up to 20% of the number specified herein. For example, as described, PTMs are generally mounted on the peripheral deck either vertically or at an angle up to approximately 45° from vertical may include angles of plus or minus 20% of the 45° specified and the vertical specified may include plus or minus 10° from vertical. Accordingly, a range of approximately 0°, from vertical, to 45°, may be interpreted to include a range of substantially between −10° from vertical to 55° from vertical. As the PTM generally resides on the peripheral deck with other components such as bill validators, printers, buttons, USB chargers, speakers, etc., very restricted width and height dimensions are preferably necessary. One reason for this preference is that the vast majority of EGMs conform to industry standard dimensions. For instance, upright EGMs which sit on slot stands are generally 24" wide while slant or hybrid EGMs which are placed directly on the slot floor are approximately 28" wide. Accordingly, many PTM displays are approximately 6.2" (X-axis) or less wide and approximately 2.3" high (Y-axis). However, while the height and width are restricted, the depth of the PTM (Z-axis) is not so restricted as the assembly depth can go far into the interior of the cabinet. In carrying out the embodiments of the present invention, somewhat opposite dimension restrictions come into play. As the button deck is usually large with limited additional components, relative to the peripheral deck, there is far more height (Y-axis) and width (X-axis) room for the digital button display device incorporating player tracking functionality, thereby allowing for far larger displays even up to 19" in width or larger. However, while the height and width are far less restrictive, the depth of the assembly is considerably restricted, generally limited to approximately 3.0" in depth, depending on the button deck relative thickness. Otherwise, the height of the button deck would be too high for player comfort or conversely, potentially limit or hit a player's legs while seated at a slant or hybrid EGM. Accordingly, a typical EGM with digital button display device incorporating player tracking functionality, optimally must reside in an envelope no larger than approximately 19" wide, 16" high and a depth of 3.0". Often the digital button display device incorporating player tracking functionality requires circuit boards to be generally mounted parallel with the display while conventional PTMs generally may have circuit boards often mounted substantially perpendicular to the PTM display along with magnetic cards readers and the like. However, neither is mandatory, depending on circuit board design. While many conventional PTMs have built in magnetic card readers, it is generally advantageous for the digital button display device incorporating player tracking functionality to have remote or separate card readers. One skilled in the art will recognize that while that dimensions and other relationships outlined are the norm, they are not necessarily universal in all cases or cabinet types.

While carrying out the embodiments of the present invention, a number of display options are possible. In one embodiment, the digital button display device incorporating player tracking functionality display is shared between player tracking and player reward functions and game functionality buttons. In another embodiment, the display is selectable between game functions and player tracking and player reward functions. In yet another embodiment, the display automatically toggles between game function buttons and player tracking and player reward functions depending on game activity. For example, when a new player sits down at a game, the player tracking and player reward functions may be shown and after a player either inserts their players card or deposits funds to play the display toggles to game functionality.

Other variations, embodiments and features of the present invention will become evident and/or apparent from the following detailed description, drawings and claims.

DETAILED DESCRIPTION

Figure 1:
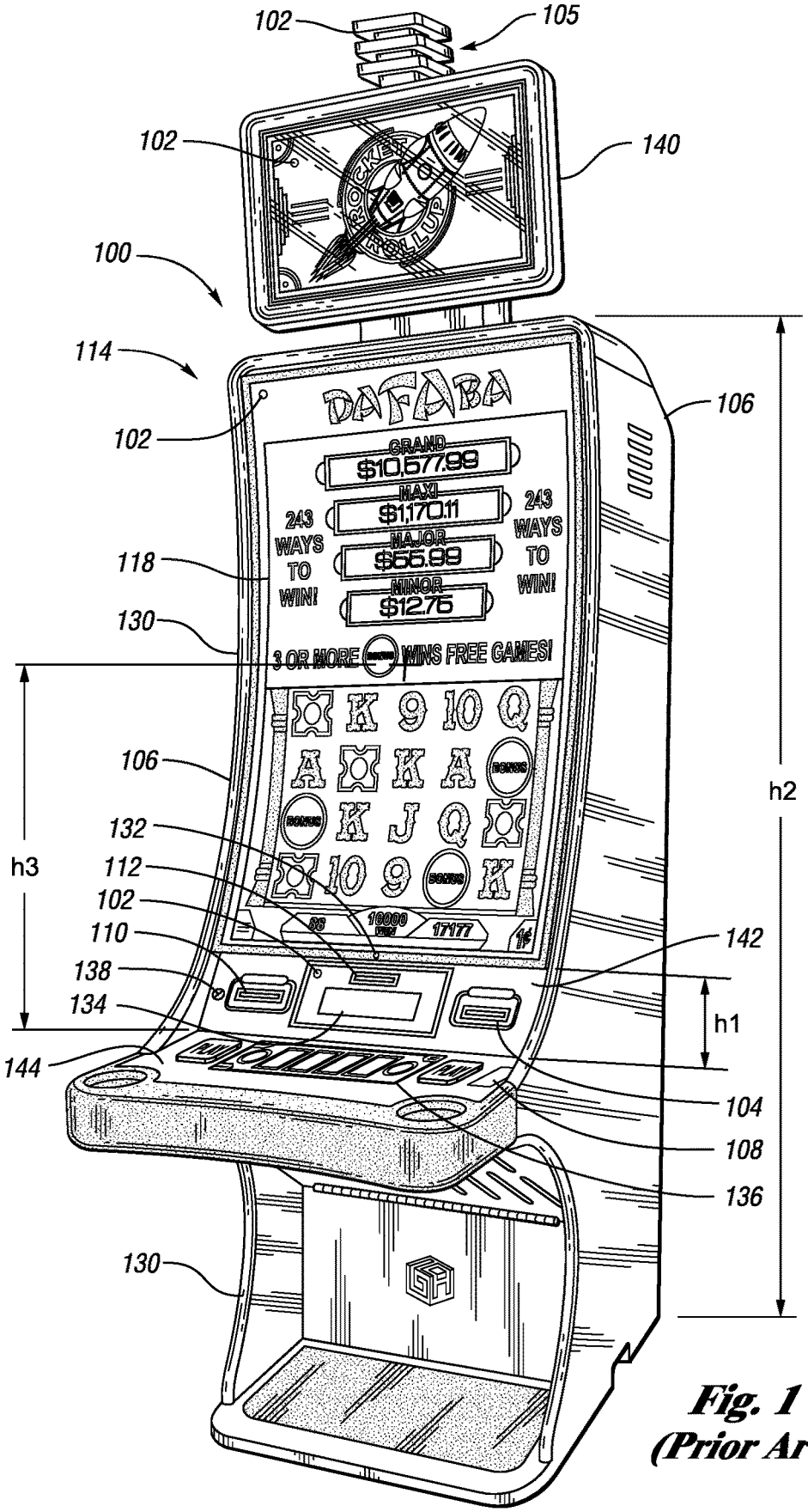
Fig. 1 (Prior Art)
FIG. 1 illustrates a conventional electronic gaming machine including a digital button panel and player tracking module.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

One skilled in the art will recognize that the embodiments of the present invention involve both hardware and software elements, which portions are described below in such detail required to construct and operate a game method and system according to the embodiments of the present invention.

As will be appreciated by one skilled in the art, aspects of the present invention may be embodied as a system or method. Accordingly, aspects of the present invention may take the form of an embodiment combining software and hardware.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, solid state drives, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wired, wireless, wireline, optical fiber cable, RF, Bluetooth, near field communications, and the like, or any suitable combination of the foregoing.

Computer program code for carrying out operations for aspects of the present invention may be written in any combination of one or more programming languages, including an object-oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the EGM's computer, partly on the EGM's computer and partly on a remote computer or entirely on a remote computer or server as in a client/server relationship sometimes known as cloud computing. In the latter scenario, the remote computer may be connected to the EGM's computer through any type of network, including a local area network (LAN) or a wide area network (WAN), a combination thereof, or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams.

FIG. 1 is an illustration of an exemplary electronic gaming machine (EGM) 100 that may be used with the systems described herein. In one embodiment, EGM 100 is a gaming device 114. EGM 100 may include one or more comp indicators 102, which may be incorporated into, or implemented by, a candle device 105, lighting element 130, displayed on monitor 118, displayed on the player tracking module 134, displayed as an LED indicator on button panel 136 which is located on the button deck 144, or another device. One or more cameras 132 may be provided with or as part of the EGM 100 to capture images of the player or other aspects of game play. The button deck of hybrid or slant type EGMs generally projects outwardly from the main cabinet and may be horizontally disposed or at slight angles from horizontal and also serves as an armrest for the play. Button decks on upright type EGMs generally project out less from the main cabinet and may not contain enough room to serve as an armrest for the player. Button decks of bar top EGMs are located below the main game screen, closer to the player, with the armrest provided by the bar top itself or bar top armrest.

The EGM 100 includes one or more screens including a curved portrait mounted screen 118 although other screens or screen configuration may also be employed such as, flat screen, J-curve, reverse J-curve, S-curve multiple horizontal monitors, etc. The screen 118 may be configured to display game content to the player or any other information regarding the game, the casino, rules, pay tables, promotions, advertisements, or any multimedia content. In one embodiment, the screen 118, also referred to as a primary game display, may comprise multiple, separate displays. Additional lights 130 may be incorporated into the gaming machine to providing lighting for the player or ornamentation for the EGM 100.

A scanner 108 is provided to scan tickets which have bar or box codes, or for scanning money, cards, or any other media. In addition, scanner 108 may include other connectivity means such as blue tooth communications, near field communications or similar. Similar, a card reader 112 is provided to read one or more aspects of cards, such as player tracker or rewards cards, personal identification cards, and/or credit cards and is located on the peripheral deck 142. The EGM 100 may also include a printer 110. The printer may print on any type media depending on the printer capabilities. Any type content may be printed including but not limited to cash out tickets, coupons, gift certificates, comps, prizes, gaming codes, redemption codes, bar or box codes, receipts, IRS reporting documents, or any other type of information. Also, part of this embodiment is a cash acceptor 104 configured to accept paper money, ticket-in-ticket-out vouchers, or any type physical item associated with the gaming machine 100. A USB port 138 or other type charging or I/O port is provided for phone charging or interfacing the user's phone to the gaming machine. Numerous other buttons and player interface elements are presented with the gaming machine to accept player input. The screen 118 may be configured as a touch screen.

Three dimensional relationships are illustrated including h1 which represents the vertical distance between the top of the button deck and the base of the game display, h2 which represent the vertical height of the EGM from the base to the top of the LCD topper, and h3 which is the vertical distance between the top of the button deck to the center of the game display. Those skilled in the art will recognize that while the center of portrait mounted displays are discussed in detail, the same relationships exist with EGMs utilizing multiple display such as dual or triple displays. In most cases, a slot topper, if utilized, even if a LCD display, does not display game play as it usually displays only advertising or marketing information and as such would not be included in any calculations. In the case of multiple monitors, the center of game display is the center of height of the separate displays as measured from the bottom of the lower game display and the top of top of the top display. Although the center of the game display in these configurations may exist in an area between displays in some cases, it nevertheless is generally the average height for the player viewing angle when a player views the separate displays.

Figure 2:
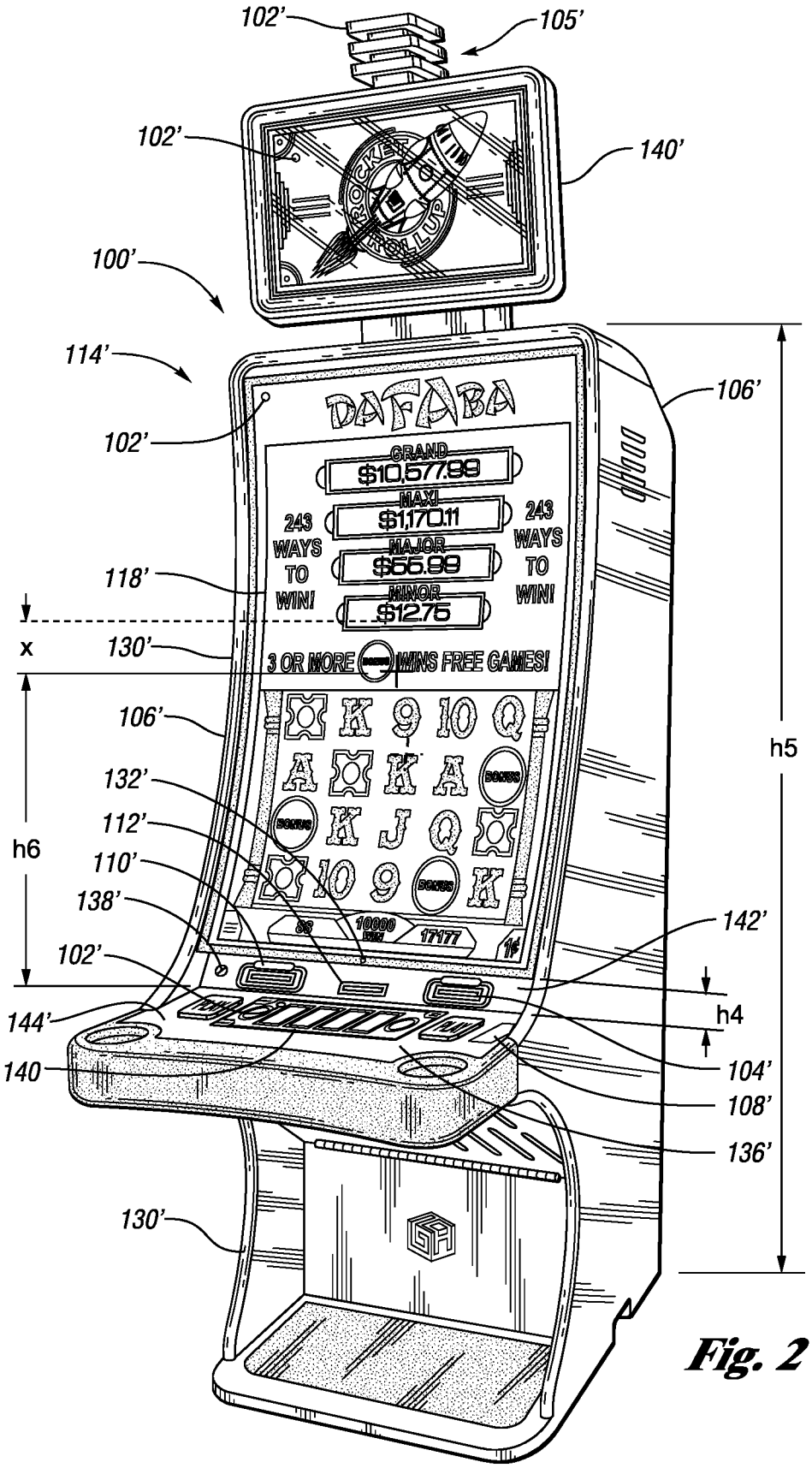
FIG. 2 illustrates an electronic gaming machine including a digital button display device incorporating player tracking functionality according to the embodiments of the present invention.

FIG. 2 is an illustration of an exemplary electronic gaming machine (EGM) 100' that may be used with the systems described herein. In one embodiment, EGM 100' is a gaming device 114'. EGM 100' may include one or more comp indicators 102', which may be incorporated into, or implemented by, a candle device 105', lighting element 130', displayed on monitor 118', displayed on the button deck 144' with player tracking capabilities 140', displayed as an LED indicator on button panel 136', or another device. As used herein, player tracking encompasses tracking play, player interaction, managing player rewards, displaying game play point status, advertising, casino promotions, etc. Thus, player tracking capabilities/functionality includes tracking player play, managing player rewards and any other functions which may be desirable for the player or casino. One or more cameras 132' may be provided with or as part of the EGM 100' to capture images of the player or other aspects of game play.

The digital button display device incorporating player tracking capabilities 140' is located on the button deck 144' and generally on a horizontal plane. One skilled in the art will recognize that other angular placements are also possible. The button deck 144' with player tracking capabilities 140' cooperates with and communicates with the slot accounting system or similar. Preferably the button deck 144' with player tracking capabilities 140' communicates with a remote card reader 112' which is located on the peripheral deck 142'.

The comp indicator 102' visually notifies or alerts the player or casino staff when the player is determined to be eligible to receive one or more comps from a gaming establishment, for example. The comp indicator 102' may also display or otherwise notify the player of the progress towards attaining the comp or comps. Such comps may include, for example, one or more free beverages, free meals, free rooms, free credits for one or more games of chance, free prizes, free tickets to a performance, free services (e.g., spa services), and/or a discount or reduced price for one or more of the foregoing goods or services (e.g., with respect to a market price of the goods or services). In one embodiment, comp indicator 102' may include an audio notification or other sensory notification in addition to, or in place of, the visual notification. While comp indicator 102' is described as being used with EGM 100', it should be recognized that comp indicator may be used with any gaming device 114' and/or computing device.

The EGM 100' includes one or more screens including a curved portrait mounted screen 118'. The screen 118' may be configured to display game content to the player or any other information regarding the game, the casino, rules, pay tables, promotions, advertisements, or any multimedia content. Any type screen may be used, such as a flat screen, curved screen, J-curve, reverse J-curve, or S-curve display. In one embodiment, the screen 118', also referred to as a primary game display, may comprise multiple displays. Additional lights 130' may be incorporated into the gaming machine to providing lighting for the player or ornamentation for the EGM 100'.

A scanner 108' is provided to scan tickets which have bar or box codes, or for scanning money, cards, or any other media. In addition, scanner 108' may include other connectivity means such as blue tooth communications, near field communications or similar. Similar, a card reader 112' is provided to read one or more aspects of cards, such as player tracker or rewards cards, personal identification cards, and/or credit cards. The EGM 100' may also include a printer 110'. The printer may print on any type media. Any type content may be printed including but not limited to cash out tickets, coupons, gift certificates, comps, prizes, gaming codes, redemption codes, bar or box codes, receipt, or any other type of information. Also, part of this embodiment is a cash acceptor 104' configured to accept paper money, ticket-in-ticket-out vouchers, or any type physical item associated with the gaming machine 100'. A USB port 138' or other type charging or I/O port is provided for phone charging or interfacing the user's phone to the gaming machine. Numerous other buttons and player interface elements are presented with the gaming machine to accept player input. The screen 118' may be configured as a touch screen.

Three height dimensional relationships are illustrated including h4 which represents the vertical distance between the top of the button deck and the base of the game display, h5 which represent the vertical height of the EGM from the base to the top of the LCD topper, and h6 which is the vertical distance between the top of the button deck to the center of the game display. As FIG. 2 is compared to FIG. 1, h4, h5, and h6 are significantly shorter than h1, h2, and h3, respectively. One key consideration of the embodiments of the present invention is to shorten these key dimensions for a variety or reason as discussed.

Figure 4:
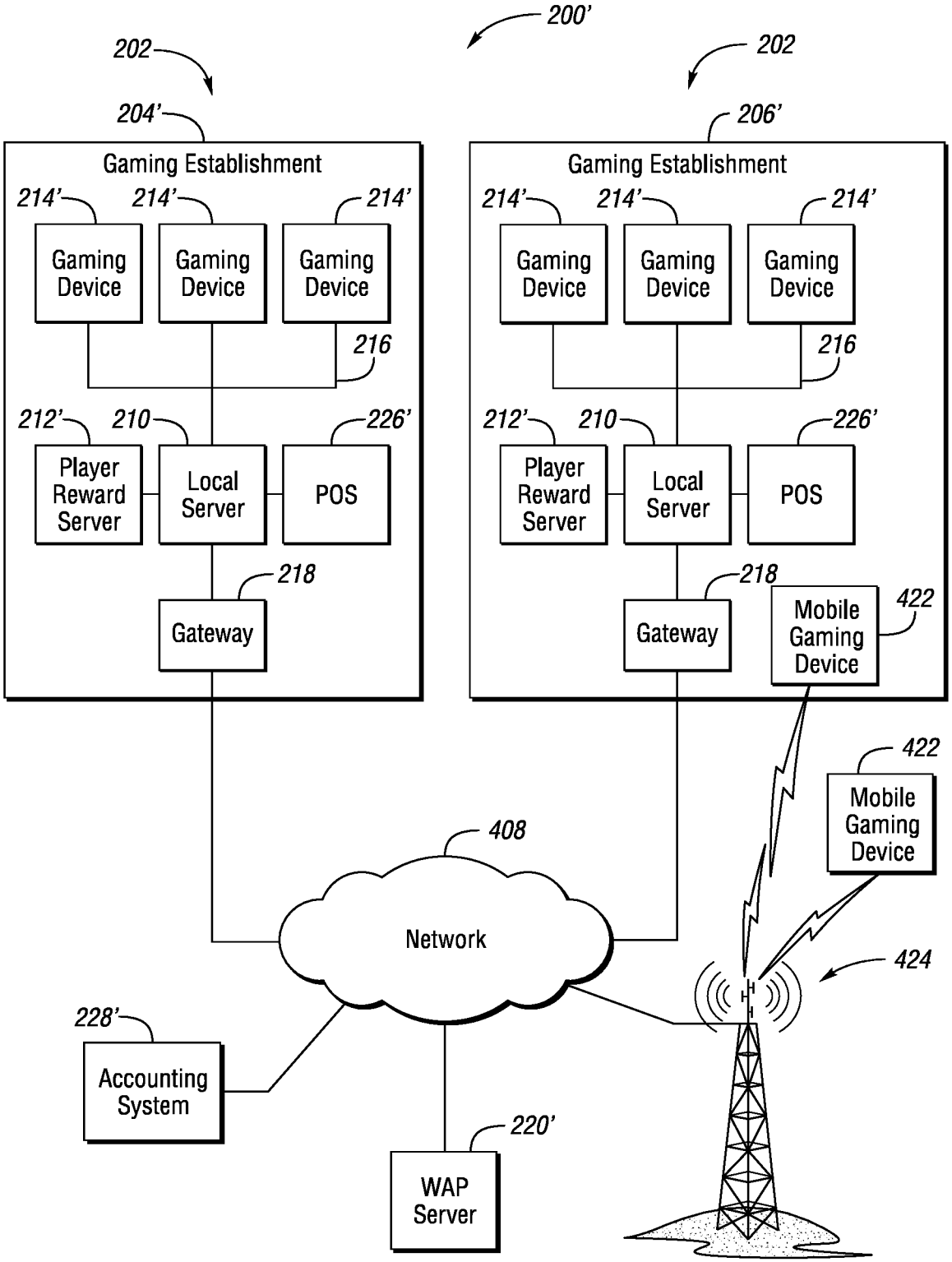
FIG. 4 illustrates a block diagram of a wireless network system of the type that may be used to facilitate the embodiments of the present invention.

FIG. 4 illustrates a block diagram of a multiple property system that may be used to play a game of chance. This figure provides a view of exemplary gaming systems in one or more casinos. In one embodiment, a plurality of gaming devices 214' are connected to one or more servers 210 over a network 408', such as a wide area network (WAN) and/or a local area network (LAN). In one embodiment, the gaming devices 214' are electronic gaming machines (EGMs), otherwise known as "slot machines." These may be classified as Class II, Class III, video lottery terminals (VLT), or the like. EGMs may present either one or a plurality of games to the player such as video reels, video poker, video keno, video bingo, electronic table games, and the like. In another embodiment, the gaming devices are gaming kiosks or terminals. The servers may include one or more local servers 210 within a gaming establishment 202 and/or one or more local area progressive (LAP) servers and/or one more wide area progressive (WAP) servers 220 connected to the local servers and/or to the gaming devices 214' through the network 408.

In one embodiment, each gaming device presents either one or a plurality of games of chance to a player to enable the player to select and play the games of chance. In addition, each gaming device may include a randomization device, such as a random number generator (RNG) and/or a permutation generator, that is used to play a selected game on the gaming device. The randomization device may be used to randomly determine a game outcome for the game of chance. For example, if the player selects a game of bingo to be played on a gaming device, the gaming device uses the randomization device to select a plurality of house indicia from a pool of indicia to be used during the game. In another embodiment, at least some aspects of the game are provided by one or more servers, such as a local server 210, a wide area server, a local area progressive server (LAP), or a wide area progressive server (WAP) 220'. The server or servers may include a randomization device for randomly selecting the house indicia in the bingo game or any other wagering event.

In the example of a video poker game, either one or a plurality of games are presented to the player. After game selection and wagering, a number of playing cards, generally selected from a 52-card deck, are distributed to the player. In the case of draw poker or its many variants, the player selectively chooses to retain one or more of the original cards dealt and to discard those cards not chosen to be retained. The discarded cards are then replaced by new cards. If the player obtains a predefined winning combination of cards, the player wins an amount associated with the particular combination of cards.

In the example of mechanical, electromechanical, or video reel machines, the games may include a number of mechanical or simulated rotating reels that are arranged in a horizontal configuration forming columns or vertical configurations forming rows. Alternatively, simulated rotating reels may be arranged in a vertical configuration forming columns or vertical configurations forming rows. One or a number of rows are presented to the player to allow for one or many different winning pay lines. Pay lines may be straight across or designed in any convenient fashion. A typical game many include five reels or columns and three or four rows or the like or a vertical configuration of five rows and three or four columns and the like.

In the example of the bingo game, the house indicia are compared to a plurality of player indicia that are included within a pattern selected for one or more player cards. If at least some of the player indicia within the pattern are matched by the house indicia, the player may win a prize based on the number of house indicia that have been matched and an associated pay table.

In the example of a keno game or a keno-related game of chance, the gaming device uses the randomization device to randomly select a plurality of house indicia in a similar manner as described with respect to the game of bingo. However, twenty house indicia are typically randomly selected or called from a pool of 80 house indicia, although other sizes of house indicia pools may be used. The called house indicia are compared to a plurality of player indicia to determine how many player indicia are matched by the house indicia and may be irrespective of a pattern of the player indicia. The embodiments described herein may include allowing the player to select the number of and specific player indicia to be utilized for a keno game or may include an automated or quick pick selection. For example, a player may select one player indicia or spot to play a 1 spot game, 2 player indicia or spots for a 2-spot game, 3 player indicia or spots for a 3-spot game, etc. Embodiments may also require a minimum number of player indicia or spots to match to win a game. For example, 10-player indicia or 10 spot game may require a minimum of 5-player indicia or spots to match the randomly selected player indicia. Embodiments may also include a maximum number of player indicia or spots that are playable. For example, in an 80-number game, the maximum number of house indicia or spots selectable by the player may be confined to 20 numbers or less or a 20-number game or less. Accordingly, in an 80-number game, the minimum number of player indicia or spots may be 2 and the maximum player indicia or spots may be 20. The player may win one or more prizes based on the number of player indicia matched by the called house indicia.

As the player plays the games, the gaming device and/or a server or another computing device tracks data representative of the gameplay of the player (referred to herein as "gameplay data"), such as a theoretical win or loss, a past history, wager amounts, a number of plays per hour, wager amounts relative to an amount of time spent playing games on the gaming device, a number of wins or losses of the player, a cumulative amount wagered by the player, an amount of money won or lost by the player, and/or any other suitable data. The gameplay data is used to determine whether the player is eligible to receive a comp. The comp may include, for example, one or more free beverages, free meals, free tickets, reduced price meals or tickets, or the like.

In one embodiment, a comp indicator is included within, attached to, or displayed on the gaming device. The comp indicator may be energized or activated in any conventional way to indicate status including displaying on the game monitor, player tracking module or the like. The comp indicator is used to display to the player and/or to gaming establishment employees whether the player is eligible to receive the comp. If the gameplay data indicates that the player has reached a predetermined threshold of play and/or wagering activity, for example, the player is determined to be eligible to receive the comp. The comp indicator may then be activated to notify the player and/or gaming establishment employees that the player is eligible to receive the comp. The comp indicator activation may include any suitable means for displaying comp status, comp eligibility, change in comp status, incremental progress toward comps, continual progress toward comps, reduction in comp status after awarding of comps, etc., and may include any visual or sensory indicator or indication. Gaming establishment employees may then take action in response to the notification, such as by awarding the comp to the player. While the comp indicator is sometimes described as being a visual indicator, it should be recognized that the comp indicator may notify the player and/or gaming establishment employees using any suitable sensory perception, via printed comp tickets or the like.

A technical effect of the systems and methods described herein includes one or more of: (a) presenting a game of chance to a player on a gaming device; (b) enabling the player to input money, credits, electronic funds transfer or physical items representing money or credits for use in the game of chance using a payment input device of the gaming device; (c) enabling the player to withdraw money or credits from the gaming device using a payment output device of the gaming device; (d) providing a comp indicator attached to or integrated within the gaming device, wherein the comp indicator is configured to provide an indication if the player is determined to be eligible for a comp; (e) generating gameplay data associated with the game of chance or skill-based game of chance for the player using the gaming device; (f) receiving input from the player at the gaming device to enable the player to play the game of chance; (g) randomly determining a game outcome for the game of chance using a randomization device; (h) transmitting the gameplay data from the gaming device to a computing device; (i) determining, by the computing device, whether the player is eligible for the comp based on the gameplay data; and (j) transmitting data representative of whether the player is determined to be eligible for the comp from the computing device to the gaming device.

Comp monitoring or accounting may also be monitored locally or remotely by management to ensure proper compliance. Systems and methods described herein may be self-contained within a gaming device or may reside in a server-based system such as a slot accounting system (SAS).

As used herein, a "game of chance" or "game" refers to a manual or an electronic game that is played by a player in which an outcome of the game of chance is at least partially based on chance or a random selection of game components or skill-based game components. A game may be categorized by a game variety and/or a game size, for example. It should be recognized by one of ordinary skill in the art that the term "random" is not limited to true randomness, such as truly random numbers. Rather, pseudorandom numbers and pseudorandom algorithms are included within the meaning of "random." In addition, one of ordinary skill in the art will recognize that permutation generators may additionally or alternatively be used to generate player card indicia or other game components.

Gaming devices described herein may use real money for play or may utilize a credit-based system in which the credits used for the games may or may not have a cash value. Similarly, prizes for the games may be in the form of credits, cash, and/or physical prizes such as televisions, automobiles, or the like.

A "local game" is a game that is played by players within a predetermined location, such as within a single gaming establishment, or players playing the game across a local area network. A "local prize" or a "local payout" (including a local progressive prize or a local progressive payout) is a prize that may be won during a local game. As used herein, the terms "connect" and "couple" are not limited to only including direct connections. Rather, unless otherwise specified, indirect connections are included within the definitions of "connect" and "couple." For example, two devices may be considered to be connected together even if there are other devices or components connected between the two devices. Any suitable A player reward card refers to a physical or electronic card, token, or other device or data that enables a system to identify a player in connection with, among other things, a reward program or campaign. Accordingly, the player reward card may serve to identify the player and may enable gameplay, credits, funds, or other data to be associated with the player. In addition, player card tier levels may be established to denote the level of player play or relative worth to the casino operator.

Figure 3:
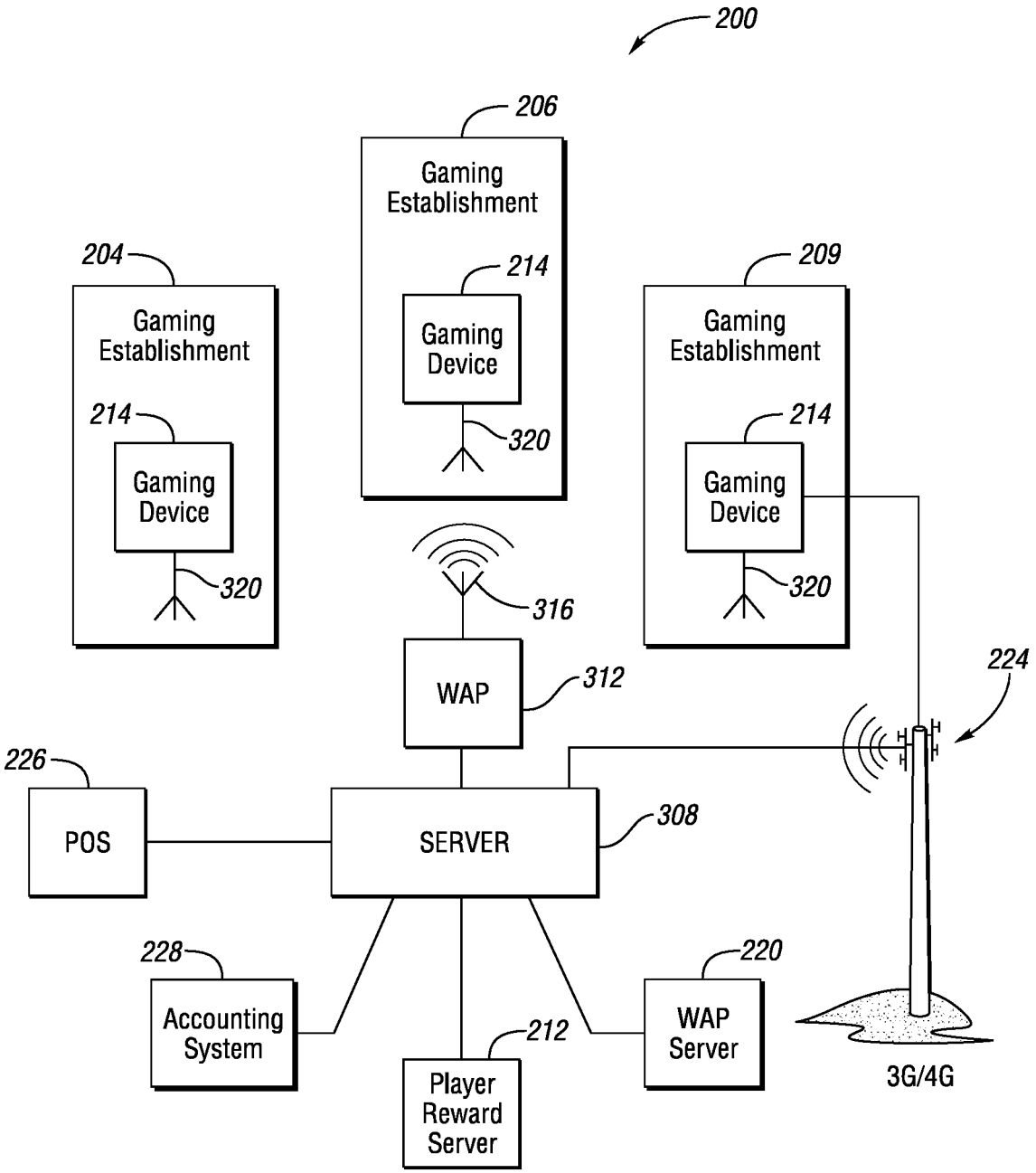
FIG. 3 illustrates a block diagram of a multiple casino property system of the type that may be used to facilitate the embodiments of the present invention.

In the embodiment shown in FIG. 3, the system 200 includes a plurality of gaming devices 214 that are positioned in a plurality of gaming establishments 204, 206 and 209. Gaming devices 214 may connect to a server 308 through a wireless access point 312. The wireless access point 312 includes an antenna 316 configured to wirelessly transmit to and receive signals from antennas 320 associated with the gaming devices 214. Wireless communications systems and methods are understood by one of ordinary skill in the art and as such are not described in detail here. For example, the gaming devices 214 may be playing one or more stand alone or Internet-based games that connect to the WAP server 220 through a server 308. In some embodiments, one or more gaming devices 214 may connect to the WAP server 220 and/or to the player reward server 212 through a wireless data network as described above. Accordingly, the gaming devices 214 interact with WAP server 220 to play the game, and WAP server 220 performs the game administration and other tasks handled by local server 210 as described. In a similar manner, a POS terminal 226 may connect to a gaming device 214 and/or WAP server 220 via server 308. In addition, the system 200 may include an auditing system 228 coupled to WAP server 220 and/or a gaming device 214, for example, through network 308. Accounting (auditing) system 228 may be used to audit and/or track components of system 200 to ensure compliance with applicable regulations.

During operation, the player utilizes or selects a gaming device 214 and initiates a gaming session to play one or more games on the gaming device 214. The player inserts a player reward card or enters a player reward number or other identification information into the gaming device 214. The gaming device 214 transmits the identification information to player reward server 212 to establish the player's identity and to associate the gameplay with the player account. The player reward server 212 authenticates the player and the gaming device 214 and may authorize the player to play the game on the gaming device 214. In one embodiment, the gaming device 214 also transmits the identification information to the WAP server 220 to enable the WAP server 220 to associate the player with the game to be played. As previously described, player identification or authentication may be optional.

In another embodiment, the WAP server 220 authenticates the player using the player identification information in addition to, or instead of, the authentication performed by the player reward server 212. In some embodiments, the player reward server 212 is omitted and the functions of player reward server 212 are incorporated within WAP server 220.

The player selects a game to play and enters a wager using gaming device 214. If the player selects a game that is operated by the WAP server 220 or that includes one or more progressive prizes administered by the WAP server 220, the gaming device 214 transmits the wager and game selection to the WAP server 220. The WAP server 220 may increment the progressive prizes based on the wager received from the player and may communicate the updated prize amounts over the wireless channel via the server 308 to all other players (via associated gaming devices 214) playing to win the progressive prizes.

Although shown as a wireless network, it is contemplated that the same functionality may be implemented in a wired system, or a combination of both.

The player plays the game on gaming device 214. The following gameplay is described as being administered by the WAP server 220. However, it should be recognized that the gameplay may be alternatively or additionally administered by the gaming device 214. For example, if the gaming device 214 is a cellular phone or a tablet computing device, the gameplay may be administered through an application installed on gaming device 214.

FIG. 4 is a block diagram of another system 200' that may be used to play one or more games of chance, such as video poker, video slots, sports betting, bingo, keno or any the wagering game. The games of chance may be played by a player against other players or may be played by the player against the house. Unless otherwise specified, the system 200' is similar to system 200 (shown in FIG. 3) and similar components are labeled in FIG. 4 with the same reference numerals used in FIG. 3 but with a prime symbol added after the reference numeral, where appropriate.

System 200' is operated using components and devices within one or more gaming establishments 202, such as a first gaming establishment 204' and a second gaming establishment 206'. It should be recognized that any suitable number of gaming establishments 202 may be provided within system 200'. Accordingly, system 200' is not limited to including two gaming establishments 202 as illustrated. In one embodiment, gaming establishments 202 are locations in which devices (e.g., gaming devices) that play or operate at least a portion of the game of chance are located. For example, gaming establishments 202 may be casinos, racetracks, bingo halls, keno parlors, or any other establishments. In another example, gaming establishments 202 may be residences or businesses in which one or more devices are located for playing or operating the game of chance. Gaming establishments 202 may additionally or alternatively include any combination of the examples described herein.

In one embodiment, gaming establishments 202 are physically remote from each other and are communicatively connected to at least one network 408, such as a wide area network (WAN), a metropolitan area network (MAN), and/or the Internet, for example. Alternatively, the gaming establishments 202 may be separate rooms or sections of a casino or another facility that are communicatively connected by network 408. It should be recognized that network 408 may be a wired Ethernet network, a wireless Ethernet network, a combination of wired and wireless Ethernet networks, or any other suitable wired and/or wireless network.

In one embodiment, each gaming establishment 202 includes a local game server 210 (referred to herein as a "local server") and a player reward server 212'. Local server 210 and player reward server 212' may alternatively be implemented as or within a single server. The local server 210 is coupled to a plurality of the gaming devices 214' through an internal network 216, such as a private local area network (LAN) within the gaming establishment 202, for example. The gaming devices 214' may be located in separate gaming establishments 202, or within the same gaming establishment 202. In one embodiment, a gateway 218 is provided to enable the local server 210 of each gaming establishment 202 to securely connect to the network 408.

In one embodiment, the local server 210 is a server computer (or "server") that monitors and controls the games played on gaming devices 214', including local games. In one embodiment, the local games include games that are played against the house and/or that are played against other players In addition, the local server 210 may administer other background tasks that enable games to be played on the gaming devices 214'. For example, the local server 210 may facilitate authenticating gaming devices 214' and the players using the gaming devices 214' and may facilitate allocating payments or credits between players and the house. The local server 210 may include payment processing capabilities to enable players to receive electronic funds from a bank or another financial institution or to deposit electronic funds to the bank or financial institution. Alternatively, the payment processing capabilities may be included in a separate server or another device that is communicatively connected to the local server 210. In addition, the local server 210 may interface with the player reward server 212' to facilitate tracking and administering player rewards. Each gaming device 214', group of gaming devices 214', local servers 210, player reward servers 212', or the like may collect and/or generate data desired for accounting purposes, such as for use in slot accounting systems.

In one embodiment, the local server 210 may enable the gaming devices 214' within the gaming establishment 202 to participate in one or more games that share one or more progressive or pari-mutuel prizes with other gaming establishments 202 and/or gaming devices 214'. While progressive prizes are described in embodiments herein, it should be recognized that pari-mutuel prizes may be substituted as desired, and vice versa or additive. In such an embodiment, each local server 210 may be coupled to a wide area progressive (WAP) server 220' that administers the prizes. For example, the WAP server 220' receives data from each local server 210 and/or from gaming devices 214' regarding an amount wagered by each player playing the game. WAP server 220' may allocate a portion of each wager to the prizes and may communicate the current prize amounts to local servers 210 and/or to the gaming devices 214'.

The gaming devices 214' may include one or more kiosks or electronic gaming machines (EGMs) (also known as "slot machines"). The gaming devices 214' may additionally or alternatively include one or more desktop computers or one or more mobile gaming devices 422, such as, without limitation, cellular phones, tablet computing devices, and/or laptops. Mobile gaming devices 422 may connect to local server 210, WAP server 220', and network 408 via a wireless data network represented by cell tower 424. For example, mobile gaming devices 422 may connect to any suitable network 408 (and thereby to local servers 210 and/or WAP server 220') via a "3G", "4G" or a "5G" wireless data network. It should be recognized that mobile gaming devices 422 may additionally or alternatively connect to network 408 using another suitable wireless network, such as a wireless Ethernet network. For convenience, gaming devices 214' described herein may also include mobile gaming devices 422.

One or more point-of-sale ("POS") terminals 226' or redemption kiosks may also be included within each gaming establishment 202 to enable players to "cash out" winnings from one or more gaming devices 214' and/or to perform other account management activities related to player accounts. The POS terminals 226' may be connected to the local server 210, for example, and/or to the WAP server 220' as desired. In addition, the system 200' may include an auditing system 228' coupled to WAP server 220', the local server 210, and/or a gaming device 214', for example, through network 408. Accounting (auditing) system 228' may be used to audit and/or track components of system 200' to ensure compliance with applicable regulations.

In one embodiment, a plurality of gaming devices 214' having different operating systems and/or system architectures may connect to the local server 210 or to another suitable server to play one or more games of chance. In such an embodiment, the gaming devices 214' may be used to play a session bingo game, for example, or any other game of chance.

During operation, the player utilizes or selects a gaming device 214' and initiates a gaming session for playing one or more games of chance ("Games"). Optionally, the player inserts a player reward card or enters a player reward number or other identification information into gaming device 214'. If the identification information is entered, the gaming device 214' may transmit the identification information to local server 210 for authentication, or authentication may be accomplished locally within the gaming device 214'. The local server 210 communicates with player reward server 212' to establish the player's identity and to associate the gameplay with the player account. The local server 210 authenticates the player and gaming device 214' and authorizes the player to play the game or games on gaming device 214' if desired or required.

When game play is initiated, during selection of the game, or during play of the game, the player may be required to purchase or generate credits. The player may purchase or generate credits by inserting cash or a ticket-in-ticket-out voucher into gaming device 214' or another device. Cash, ticket-in-ticket-out vouchers, credit cards or debit cards are examples of physical items associated with the gaming device. Alternatively, or additionally, the player may transfer credits or cash to the gaming device 214' from banking accounts, credit accounts, gaming establishment accounts, and/or gaming company accounts. In one embodiment, computer-generated credits may be used with gaming device 214', for example, as part of a free-to-play game.

The player selects a game to play and enters a wager on the gaming device 214'. The gaming device 214' transmits data representative of the selected game and the wager to the local server 210. If the player selects a game that is at least partially operated by the WAP server 220' or that includes one or more progressive prizes administered by WAP server 220', local server 210 transmits the wager and game information and/or selection to WAP server 220'. The WAP server 220' may increment the progressive prizes based on the wager received from the player and may communicate the updated prize amounts via the network 408 to all other players (via associated gaming devices 214') playing to win the progressive prizes.

The player plays the game on the gaming device 214'. The following gameplay is described as being administered by the WAP server 220'. However, it should be recognized that the gameplay (i.e., the play of the game of chance) may be alternatively or additionally administered by the local server 210 and/or the gaming device 214'. For example, if the gaming device 214' is a cellular phone or a tablet computing device, the gameplay may be administered through an application installed on the gaming device 214'.

In one embodiment, the player may play a game of bingo by selecting a game or game type, one or more player cards, selecting one or more winning patterns for the player cards, and/or selecting one or more numbers or other player indicia for the player cards using the gaming device 214'. The selected player cards, winning patterns, and player indicia are transmitted to WAP server 220'. The player cards are included within one or more game tickets issued by WAP server 220', and the game tickets are communicated to the gaming device 214' via the network 408 and the local server 10. The WAP server 220' selects or receives randomly generated house indicia and compares the house indicia to the player indicia and the pattern or patterns selected for the player cards. Alternatively, the functions described herein (e.g., comparing the house indicia to the player indicia and the pattern or patterns selected for the player card) may be performed in the gaming device 214'. It should be recognized that the house indicia may be randomly generated using a randomization device, such as hardware, firmware, and/or software-based random number generator (RNG), a ball blower or console, a ball cage, and/or any other suitable device or machine that enables numbers or other house indicia to be randomly generated. In an alternative embodiment, the WAP server 220' (or another device) may designate a server, computer, or another device to provide randomly selected house indicia during the game and may receive the house indicia from the designated device.

WAP server 220' determines whether the player wins a prize based on the comparison of the house indicia to the player indicia. For example, WAP server 220' determines whether the player indicia within the pattern or patterns selected for each card match the house indicia that were randomly determined (sometimes also referred to as the house indicia that were "called"). If the player indicia within a pattern match the called house indicia, the player may win a prize based on a pay table associated with the game. The prize may be one of the progressive prizes or the prize may be a fixed prize identified in the pay table. WAP server 220' determines the appropriate payout to be paid to the player based on the pay table and transmits data representative of the payout to local server 210.

Local server 210 receives the payout data and credits the player account accordingly. In addition, local server 210 may transmit the gameplay data and/or payout data to player reward server 212' to enable player reward server 212' to update the player history and other gameplay data for the player. When the player is done playing, the player may "cash out" some or all of the credits in the player account or may deposit the credits into the player account using POS terminal or kiosk 226', for example. The player account may be stored on gaming device 214', local server 210, or player reward server 212', for example.

In one embodiment, the player may enter the wager and/or may initiate play of the game on a first gaming device 214' and may complete the gameplay on a second gaming device 214'. Alternatively, the player plays the game on the first gaming device 214' and receives the results of the gameplay (e.g., whether the player won and how much the winnings are) on the second gaming device 214'. For example, the player may begin playing the game on a kiosk or electronic gaming machine, and may complete the game or view the results of the game on a cell phone. In such an embodiment, the WAP server 220' and/or local server 210 may transmit the player's gameplay data from the first gaming device 214' to the second gaming device 214'.

Figure 5:
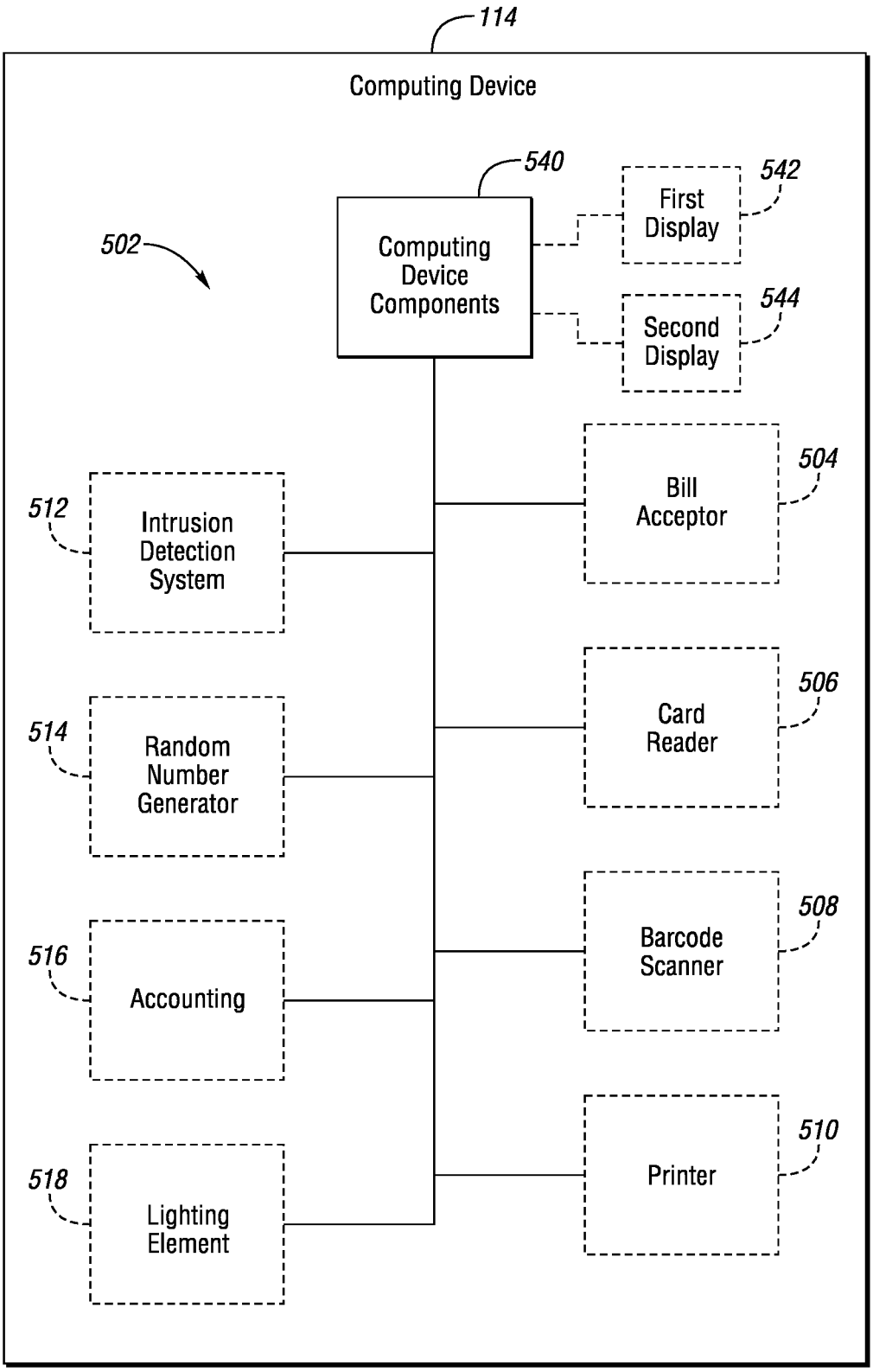
FIG. 5 illustrates a diagram of exemplary gaming device hardware of the type that may be used to facilitate the embodiments of the present invention.

FIG. 5 is a block diagram of a gaming device 114 that may be used with system 200 (shown in FIG. 3) or system 200' (shown in FIG. 4). As described above, the gaming device 114 is a computing device (such as an EGM) that includes a plurality of computing device components 502 positioned within a cabinet or other housing. In one embodiment, computing device component manager or processor 540 includes first display 542 and second display 544. In addition, gaming device 114 may include a plurality of gaming device components 502 including a bill acceptor or bill validator 504, a card reader 506, a barcode scanner 508, a printer 510, an intrusion detection system 512, a randomization device 514 (such as an RNG), and an accounting interface 516 that are positioned within, or coupled to, the cabinet or housing of the gaming device. In one embodiment, gaming device 114 may also include at least one lighting element 518 coupled to the cabinet or housing.

It should be recognized that in some embodiments, a gaming device 114 may not include each gaming device component 502 illustrated in FIG. 5. In some embodiments, the gaming device may not include bill acceptor 504, card reader 506, barcode scanner 508, and/or printer 510. Rather, in some embodiments, the functions of each omitted gaming device component may be replaced by equivalent software, hardware, and/or firmware if desired. Optional components may be designated using dashed lines in the figures.

The bill acceptor 504 is a payment input device that enables gaming device 114 to receive and identify paper currency, ticket-in-ticket-out vouchers, electronic transfer means, or other physical items representing a monetary value. For example, bill acceptor 504 may receive and identify dollar bills or other currency that are inserted into bill acceptor 504. In one embodiment, bill acceptor 504 includes a scanner that scans paper currency inserted therein. The bill acceptor 504 may also include optical character recognition (OCR) capabilities that enable bill acceptor 504 to identify the amount of currency inserted into bill acceptor 504 from a scanned image of the currency. The bill acceptor 504 may transmit data representative of the amount of currency inserted into gaming device 114 to controller or processor 540, for example. The controller or processor 540 may cause the amount of currency to be converted into credits usable with the game and may add the credits to the player's account.

The card reader 506 is a device that "reads," or obtains data encoded in, player reward cards or other cards or media that are inserted into reader. In one embodiment, the card reader 506 is a magnetic or optical card reader that reads barcodes or magnetic strips included within a player reward card. In another embodiment, the card reader 506 wirelessly reads data encoded within the player reward card by accessing a chip, such as a radio frequency identification ("RFID") chip, embedded within the card or other similar authentication means. The card reader 506 reads the data obtained from the cards and transmits the data to the processor 540. In one embodiment, the card reader 506 is used to read player identification information encoded within player reward cards. The controller or processor 540 may transmit the player identification information to player reward server or other external component to identify the player, track past or present player activity, to allow for the transfer of funds or credits, to facilitate authenticating the player, and/or to authorize the player to play a game on gaming device 114. In one embodiment, the player may "log in" to the gaming device 114 by swiping the player reward card or otherwise passing the player reward card through or inserting the player reward card into the card reader 506. In another embodiment, the player may enter a number or other identifier associated with the player reward card into the gaming device 114, through the user interface devices for example, instead of using the card reader 506. In another embodiment, the insertion of the player reward card and player entering the identifier into user interface device may be combined. In yet another embodiment, the player may use a near field communication ("NFC") device to read the player reward card or data representative of the player card. Alternatively, the player reward card may be associated with an application on a cell phone or tablet which wirelessly communicates with the card reader or similar system.

In one embodiment, the barcode scanner 508 is an optical or a magnetic scanner that is optimized to read barcodes on media positioned proximate to the scanner and may also include RFID sensors, blue tooth connectivity, near field communications devices, etc. For example, the barcode scanner 508 may be optimized to read barcodes printed on paper receipts (sometimes referred to as "tickets" or vouchers, not to be confused with game or player tickets that may include player selected patterns, player indicia, and the like) and/or barcodes displayed electronically on a cell phone or tablet computing device. It should be recognized that the barcodes read by the barcode scanner 508 may be linear or one-dimensional barcodes, two-dimensional barcodes, or may even include data represented in a form other than a barcode. For example, the barcode scanner 508 may read images and/or text indicative of data, such as currency or credits, usable with gaming device 114. The barcode scanner 508 extracts the data from the barcode and transmits the data to controller/processor 540. For example, the barcode scanner 508 may scan a paper receipt or voucher that includes an amount of currency or credits usable by the player with a gaming device 114 and may transmit the amount of credits to the controller/processor 540. In such an example, the barcode scanner 508 may act as a payment input device. The controller/processor 540 may cause the amount of currency or credits to be displayed to the player on first display 516 (or on any display) to inform the player how many credits or currency is available to be used in playing a game.

The printer 510 may be used to print paper receipts (also known as tickets as described above), ticket-in-ticket-out vouchers, or other physical items representing a monetary value that indicate an amount of currency or credits available to the player. In many locations, the tickets or receipts may alternatively be referred to as vouchers. The printer 510 may act as a payment output device that enables a player to cash out or withdraw money or credits from the gaming device 114 by printing a voucher representative of the money or credits. In one embodiment, the printer 510 is a thermal printer that is fed by a roll of paper or any suitable paper stock. In a further embodiment, the roll of paper includes one or more watermarks that are visible when the printer 510 has printed the receipt on the paper. Alternatively, the printer 510 may print the watermark on the receipt, or may include another security mechanism to facilitate preventing counterfeit receipts from being made. For example, the printer 510 may include an image or a code on the receipt that identifies the gaming device 114, the printer 510, or another component of the gaming device along with a time that the receipt was printed, serial number, date, location, or other desired information. Other suitable security mechanisms may be used as well such as coordinated serialized numbers printed on the receipt or voucher and recorded in the slot accounting system. It should be recognized that the barcode scanner 508 and the printer 510 may cooperate such that a security mechanism printed on the receipt may be received and validated by the barcode scanner, in conjunction with controller/processor 540, for example. The barcode scanner 508 may be located remotely from the gaming device 114, such as within a redemption kiosk, a casino cage, or the like.

The intrusion detection system 512 notifies the controller/processor 540 if a case, cabinet, or other housing enclosing components of the gaming device 114 is opened or modified without authorization. In one embodiment, the intrusion detection system 512 includes a pair of contacts that may be physical, magnetic, optical, or similar that transmit an electronic signal to the controller/processor 540 if the housing of the gaming device 114 is opened (e.g., if the opening of the housing separates the contacts). In another embodiment, the intrusion detection system 512 may include a light sensor that detects a change in the light within the housing of the gaming device 114. The intrusion detection system 712 may also include a key or another mechanism for disabling the operation of the game or transmission of the signal to the controller/processor 540 in the event that maintenance or other authorized or unauthorized access to the gaming device 114 components is desired or occurs.

In one embodiment, the intrusion detection system 512 includes a software program (a "monitoring program") that monitors one or more applications installed on the gaming device 114. For example, if the gaming device 114 is a cell phone that includes an application for playing the game thereon, the monitoring program may monitor the application to determine whether the application is modified without authorization. In one embodiment, the monitoring program stores a hash value or a digital fingerprint of the application when the application is installed and/or when the application undergoes authorized modification (e.g., if the application is updated or patched). However, if the monitoring program determines that the application has been modified without authorization, the monitoring program may cause a signal or another notification to be transmitted to the controller/processor 540. For example, the monitoring program may periodically calculate a new hash value of the application and/or create a new digital fingerprint of the application. The monitoring program then compares the new hash value and/or digital fingerprint to the stored hash value and/or digital fingerprint. If the hash values or fingerprints are different, the monitoring program may determine that the application has been modified without authorization. It should be understood that the hash value, the monitoring program, and/or the digital fingerprint may be generated by any suitable means and may be encrypted for additional security.

In response to the signal or notification from the intrusion detection system 512 and/or the modification program, the controller/processor 540 may perform one or more actions. For example, the controller/processor 540 may alert an administrator within gaming establishment by transmitting a message via communication device, may cause audio output device to emit an alarm or another audible alert, may cause a display 542, 544 to display an error or a warning, message, and/or may disable the application and/or the gaming device 114 such that the game is unable to be played on the gaming device.

In one embodiment, the randomization device is an electronic random number generator (RNG) or pseudo random number generator (PRNG) 514 or a permutation generator that may be implemented by a dedicated hardware device with associated embedded software. Electronic random number generators or pseudo random number generators are used interchangeably herein. Alternatively, the RNG 514 or the permutation generator may be implemented entirely in software executing on gaming device 214. The RNG 514 may be used to randomly determine a game outcome for the game of chance. In one embodiment, the RNG 514 or the permutation generator provides house or game draws of between 1 and n numbers, where n may be a suitable number based on the game type selected to be played by the player. The RNG 514 or the permutation generator may be programmed via hardware, software, or firmware to provide a particular range of numbers (or other indicia) and numbers of draws for a particular application. For example, in one embodiment of bingo according to the present disclosure, the RNG 514 or the permutation generator initially provides 24 randomly generated numbers having values between 1 and 75 for each game. In other embodiment other methods or numeric values may be used. Additional draws or numbers may be provided to play the game to conclusion depending on the particular implementation as described in greater detail herein. In addition, the RNG 514 or the permutation generator may be used to randomly select a plurality of player indicia to be used with one or more player cards. In embodiments in which a processor, such as controller/processor 540, is described as randomly selecting indicia, it should be recognized that controller/processor may interface with randomization device 514 or the permutation generator to select the indicia. In other embodiments, controller/processor 540 may include randomization device 514 or the permutation generator, or may execute instructions to perform the functions of randomization device 514 or the permutation generator.

The accounting interface 516 is used to interface with an accounting system, such as a slot accounting system, at or operated by a gaming establishment. Accounting interface 516 may include or be connected to a network interface, such as the communication device for use in communicating gameplay data, player identification information, and/or other data to the accounting system for accounting and/or auditing purposes.

The lighting element 518 may include, for example, one or more LEDs, slot machine candles, fluorescent tubes, and/or any other element that emits light as controlled or directed by the controller/processor 540. In one embodiment, the lighting element 518 is activated to display light, or one or more lighting patterns, when the controller/processor 540 determines that a winning ticket was scanned via the card reader 506 or when the controller/processor otherwise determines that a ticket is a winning ticket. The lighting elements 518 may also be activated upon receipt of a signal from the intrusion detection system 512 (e.g., upon the determination that the gaming device 214 has been opened and/or modified without authorization) and/or upon any other suitable determination.

In one embodiment in which the gaming device 214 or kiosk may interface with another gaming device operated by or otherwise associated with the player, such as a cell phone, tablet, or another mobile device. For example, the gaming machine or kiosk may be configured to transmit a result of one or more games of chance to the player's mobile device to notify the player whether one or more player cards or game tickets are winning cards or tickets.

Figure 6:
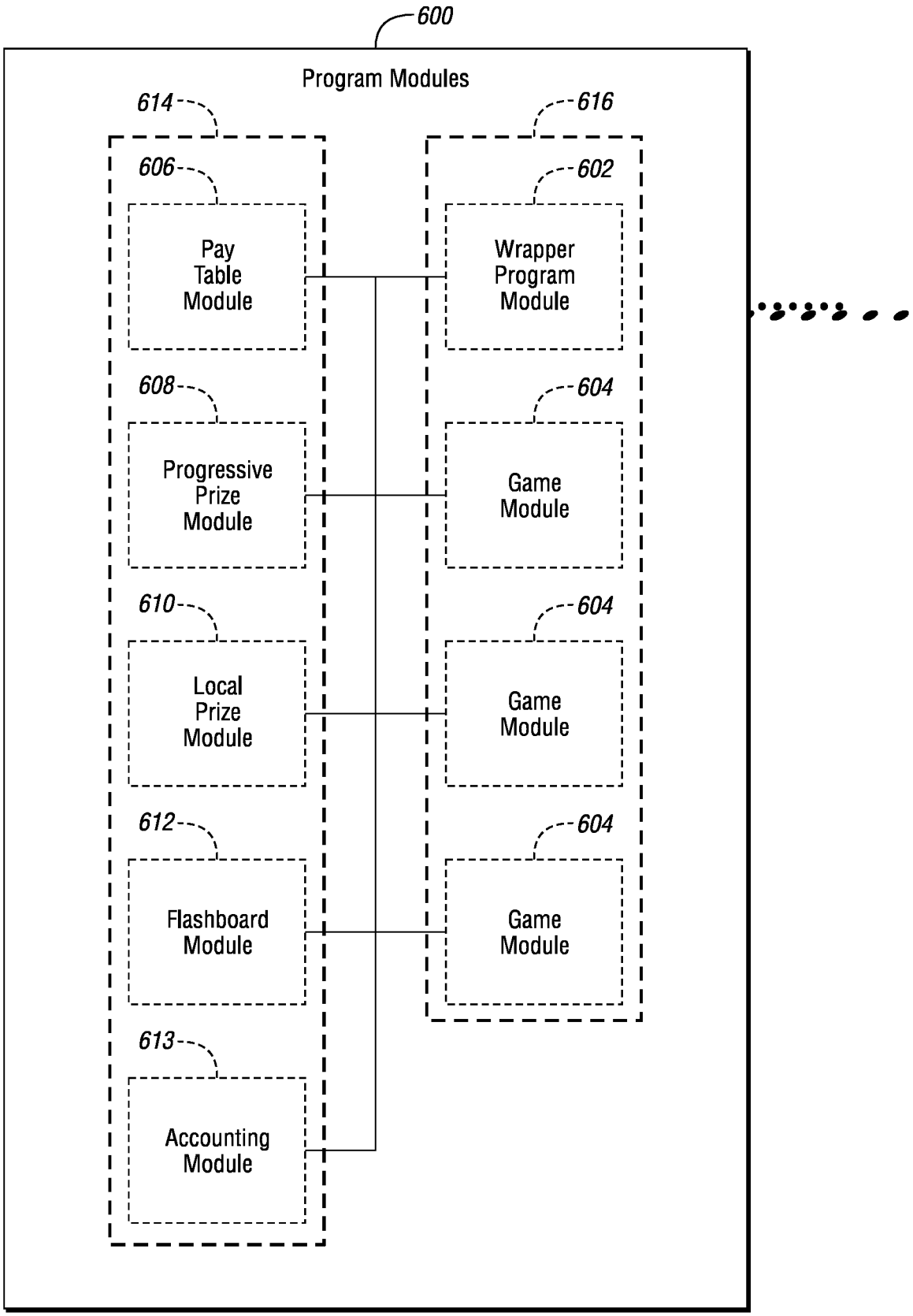
FIG. 6 illustrates a diagram of gaming device program modules of the type that may be used to facilitate the embodiments of the present invention.

FIG. 6 is a block diagram of a plurality of program modules 600 that may be used with the systems shown and described herein to administer one or more games of chance. In one embodiment, one or more program modules 600 are installed and/or stored within local server, WAP server, and/or gaming devices. For example, program modules 600 may be stored in memory device of local server, WAP server, and/or gaming devices.

The program modules 600 are hardware, firmware, or software programs or applications that, when executed by a processor, cause the processor to perform the functions described herein. In one embodiment, the program modules 600 include a wrapper program module 602, a plurality of game modules 604, a pay table module 606, a progressive prize module 608, a local prize module 610, a slot module 612, and/or an accounting module 613. A first plurality 614 of the program modules 600 may be installed within each local server and/or WAP server and a second plurality 616 of the program modules 600 may be installed within each gaming device. It should be recognized that in embodiments in which the game of chance is administered by gaming device (e.g., when a cell phone or a tablet computing device is used as gaming device), some or all of the first plurality 614 of program modules 600 may be incorporated within gaming device and executed by a processor of a gaming device. Alternatively, some or all of the second plurality 616 of the program modules 600 may be incorporated within a local server and/or WAP server. Together, the wrapper program module 602, the game modules 604, and the other program modules 600 that present and/or administer one or more games may be referred to herein as a game application, or an application.

In one embodiment, the wrapper program module 602 is used at least in part to provide a graphical user interface ("GUI") on a first display of the gaming device. The wrapper program module 602 operates to provide an entry point or a game entry interface for a player to access the gaming device, and to enable the player to select a game of chance to be played on the gaming device. For example, the games of chance may be categorized into a plurality of game sizes and a plurality of game variations. The wrapper program module 602 may present the game sizes and the game variations to the player, using a display, and may enable the player to select a game to play by selecting a game size and game variation through user interface device.

In one embodiment, the wrapper program module 602 may present a list of games or game variations to the player for selection on a display. If the player selects a size and variation, wrapper program module 602 calls or branches to a game module 604 that provides the selected game and variation.

In one embodiment, the game modules 604 each provide a game associated with the selected game size and/or game variation to the player using gaming device, local server, and/or WAP server. Accordingly, in one embodiment, each game is provided by a separate game module 604. Alternatively, each game module 604 may provide more than one game to the player.

The pay table module 606 provides a pay table associated with each game such that one or more pay tables may be associated with each game module 604. In one embodiment, the pay table module 606 provides a pay table associated with a game when the game module 604 requests the pay table and/or when a predetermined event occurs during the game. The pay tables associated with a game may be changed as desired by a game operator by any suitable means. The predetermined event may include, for example, the player selecting a "See Pays" or another icon displayed on the display that represents a request to view the pay table for the game. The predetermined event may also include reaching a point in the game in which the house indicia are matched to the player indicia within a selected pattern to determine whether the player wins a prize.

The progressive prize module 608 may be used to administer aspects of one or more progressive prizes, such as one or more progressive prizes offered to players playing across network. For example, the progressive prize module 608 may receive information regarding an amount wagered by each player playing a game that has a chance to win the progressive prize. The progressive prize module 608 may allocate a first portion of each wager to a first progressive prize to increase the size of the progressive prize. The progressive prize module 608 may allocate a second portion of each wager to a second progressive prize, and may continue in a similar manner for any additional progressive prizes, if desired or applicable. Accordingly, a plurality of progressive prizes may be provided for each game and may be at least partially funded by each or selected wagers.

The local prize module 610 may be used to administer aspects of one or more local prizes, such as one or more prizes that may be won by players playing against each other within a gaming establishment. In addition, the local prize module 610 may administer aspects of one or more fixed prizes, such as prizes that may be won only by individual players playing on respective gaming device. Accordingly, fixed or individual prizes may be awarded to a player based on the gameplay of the player relative to a randomization device of gaming device, rather than based on winning against other players.

In one embodiment, the slot module 612 may be used to control and conduct slot games in the manner and for the purposes detailed below.

The accounting module 613 may be used to interface with an accounting system, such as a slot accounting system or auditing system, at or operated by a gaming establishment. In one embodiment, the accounting module 613 is incorporated within, or executed by, accounting interface. Any suitable data, such as gameplay data, player identification information, prizes won by a player, and/or any other suitable data may be collected and transmitted by the accounting module 613.

It should be recognized that two or more program modules 600 may be combined together such that the functionality of each program module 600 is incorporated into the combined module. Likewise, each program module 600 may be split into two or more sub-modules that each perform a portion of the functionality of the program module 600 being split. Accordingly, while the above-described program modules 600 are described individually, each may be combined or split into other sub-modules as desired.

Figure 7A:
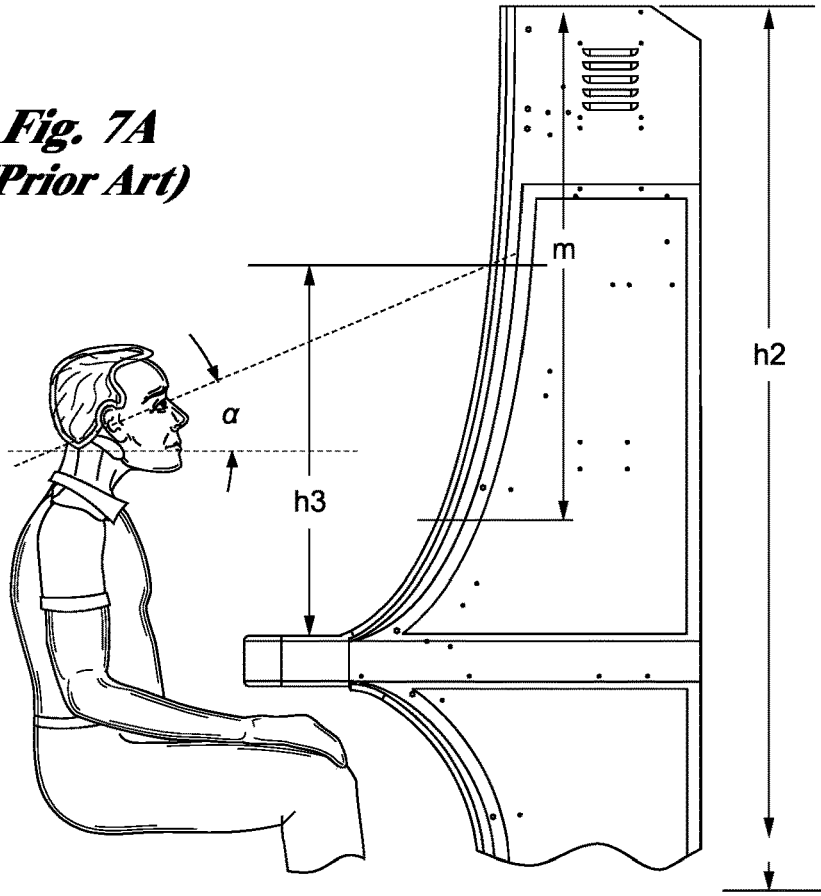
Fig. 7A (Prior Art)
FIG. 7A illustrates a side view of the EGM depicted in FIG. 1 and the player viewing angle.

FIG. 7A is a side view of the EGM depicted in FIG. 1. As shown, when the player is looking at the center of the portrait display with a height of m, the player's head will generally be cocked back which is a major concern for older players or those with orthopedic conditions. A major cause of this condition is the relative height of the peripheral deck 142. The player's viewing angle is shown as angle α which may exceed 25° in many cases.

Figure 7B:
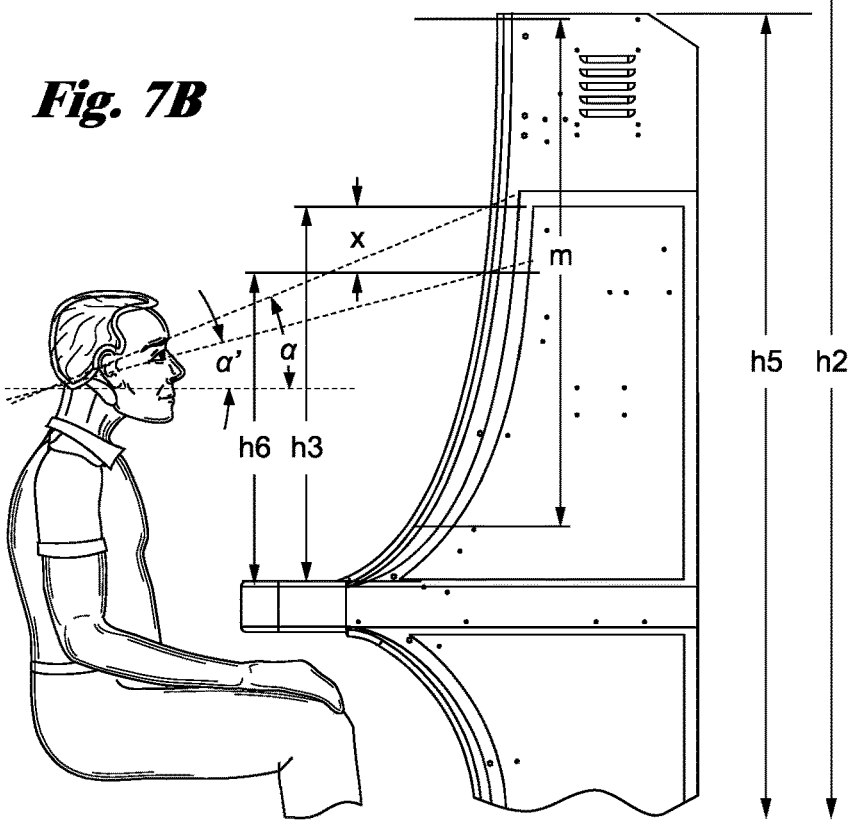
FIG. 7B illustrates a side view of the EGM depicted in FIG. 2 and the player viewing angle.

FIG. 7B is a side view of the EGM depicted in FIG. 2. As shown, when the player is looking at the center of the portrait display with a height of m (which is identical in FIG. 7A and FIG. 7B), the player's head remains in a more normal position diminishing the concern for older players or those with orthopedic conditions. This is achieved through removal of the player tracking module from the peripheral deck 142' which results in a lower height relative to the player of x. With the player tracking module/functionality removed, the peripheral deck 142' may be manufactured smaller, namely in the Y-direction. The player's viewing angle is shown as angle α' which is shown at 13° illustrating a major reduction in the player's viewing angle. While increasing or decreasing the monitor height in the prior art and with embodiments of the present invention, changes angles α and α', with the embodiments of the present invention, viewing angle α' will continue to be less than the prior art viewing angle α.

Figure 8:
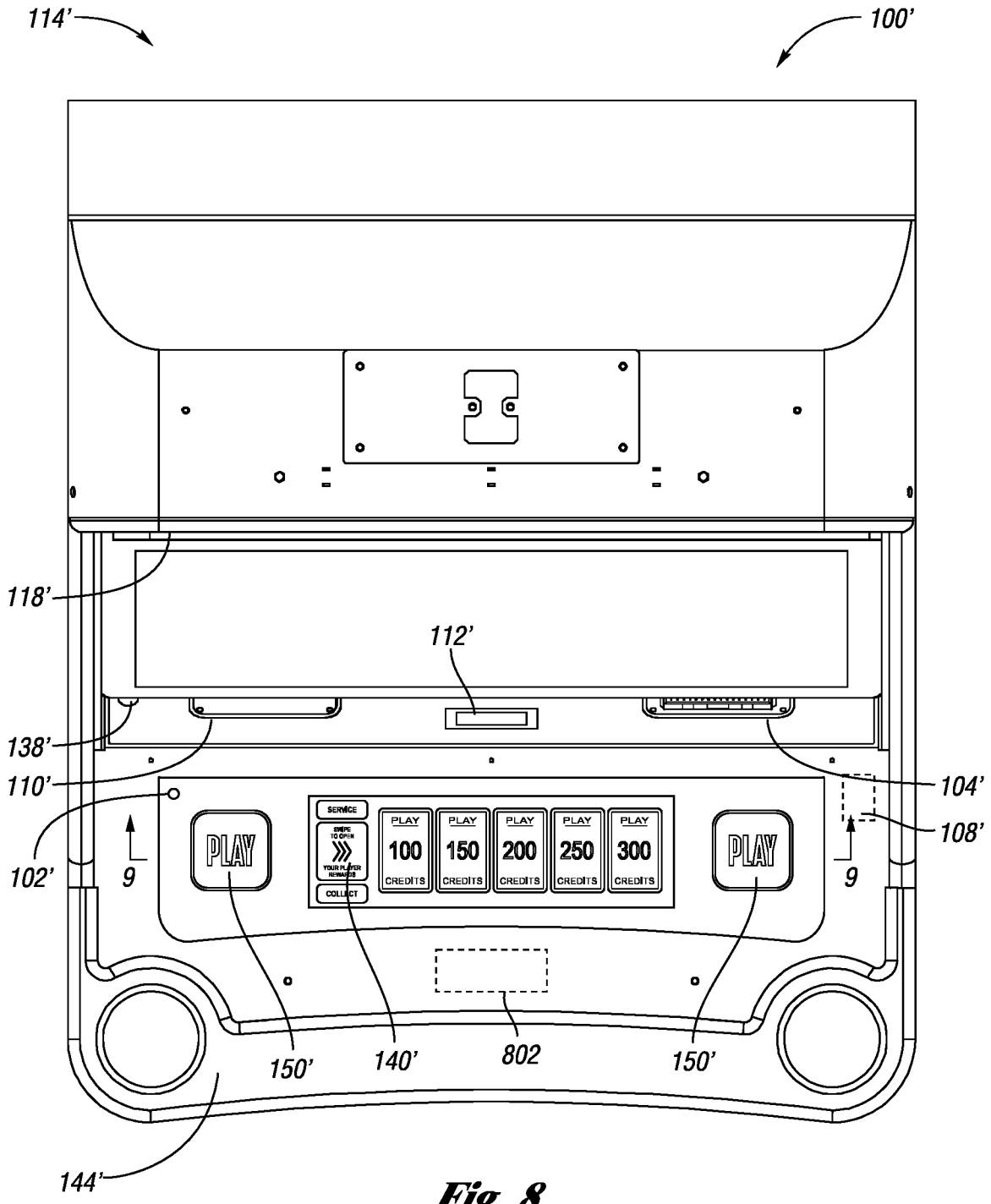
FIG. 8 illustrates a top plan view of the electronic gaming machine including a digital button display device incorporating player tracking functionality according to the embodiments of the present invention.

FIG. 8 is an illustration of an exemplary electronic gaming machine (EGM) 100' that may be used with the systems described herein. Gaming device 114' may include one or more comp indicators 102', which may be displayed on the button deck 144'. As shown, the particular type EGM is known as a hybrid or slant type machine but the embodiments of the present invention are adaptable to any type EGM including upright EGMs and bar top EGMs.

The digital button display device incorporating player tracking capabilities 140' is located on the button deck 144' and generally on a horizontal plane. The button deck 144' with player tracking capabilities 140' cooperates with and communicates with the slot accounting system. Preferably the button deck with player tracking capabilities 140' communicates with a remote card reader 112', or other authentication device, which is located on the peripheral deck 142'. Preferably, button deck 144' includes one or more play buttons 150' to initiate game play.

The EGM 100' includes one or more screens including a curved portrait mounted screen 118'. The screen 118' may be configured to display game content to the player or any other information regarding the game, the casino, rules, pay tables, promotions, advertisements, or any multimedia content. Any type screen may be used, such as a flat screen, curved screen, J-curve, reverse J-curve, or S-curve display, stacked dual or triple displays, etc.

A scanner 108' may be provided to scan tickets which have bar or box codes, or for scanning money, cards, or any other media. In addition, scanner 108' may include other connectivity means such as blue tooth communications, near field communications or similar. Similar, a card reader 112' is provided to read one or more aspects of cards, such as player tracker or rewards cards, personal identification cards, and/or credit cards. The EGM 100' may also include a printer 110'. The printer may print on any type media. Any type content may be printed including but not limited to cash out tickets, coupons, gift certificates, comps, prizes, gaming codes, redemption codes, bar or box codes, receipt, or any other type of information. Also, part of this embodiment is a cash acceptor 104' configured to accept paper money, ticket-in-ticket-out vouchers, electronic funds transfer means, or any type physical item associated with the gaming machine 100'. A USB port 138' or other type charging or I/O port is provided for phone charging or interfacing the user's phone to the gaming machine. Numerous other buttons and player interface elements are presented with the gaming machine to accept player input. The screen 118' may be configured as a touch screen.

One or more hardware and/or software interoperability modules 802 may be provided which will allow the digital button display device incorporating player tracking capabilities to effectively communicate and exchange data with the player tracking system and slot accounting system of casinos. As there are a number of player tracking and slot accounting system manufacturers, it may be necessary to adapt the data and processing to be operable for most or all player tracking and slot accounting systems whether of current design or legacy systems. The interoperability modules may be conveniently located within the button deck, behind the peripheral deck, any other appropriate location within the EGM, or embedded within or an integral part of the digital button display device incorporating player tracking capabilities itself.

Figure 9A:
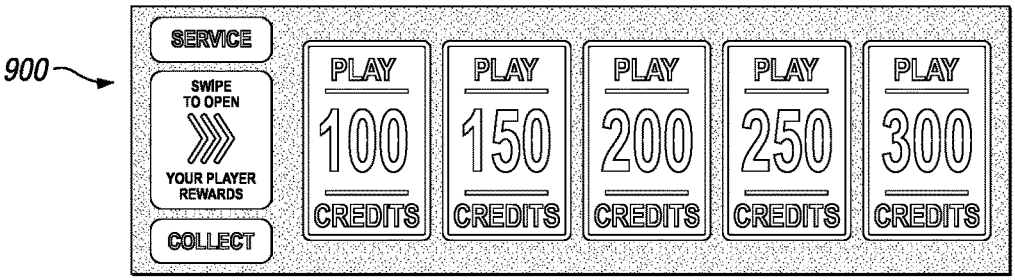
FIG. 9A illustrates one embodiment of the player interface of the button deck display of the present invention with the player tracking and player rewards functionality closed.

FIG. 9A illustrates one embodiment of the display 900 of the present invention with the player tracking and player rewards portion 902 of the display in a closed position. In this embodiment, the game functionality includes icons representing the wager of the player. The player can selectively choose their wager amount from 100 credits to 300 credits. Once selected or carried over from previous games, the player may proceed to play a game by pressing the play button 150' on the button deck 144'. The player tracking and player rewards screen is opened by swiping the icon to the right or closed by swiping the icon to the left. One skilled in the art will recognized that a wide variety of actions or gestures can be used to open or close the player tracking and player rewards screen including gestures, buttons, joystick, toggle, etc. The use of hand gestures to change screens may require a sensor (e.g., motion sensor) to be integrated into the gaming device proximate to or within the display 900.

Figure 9B:
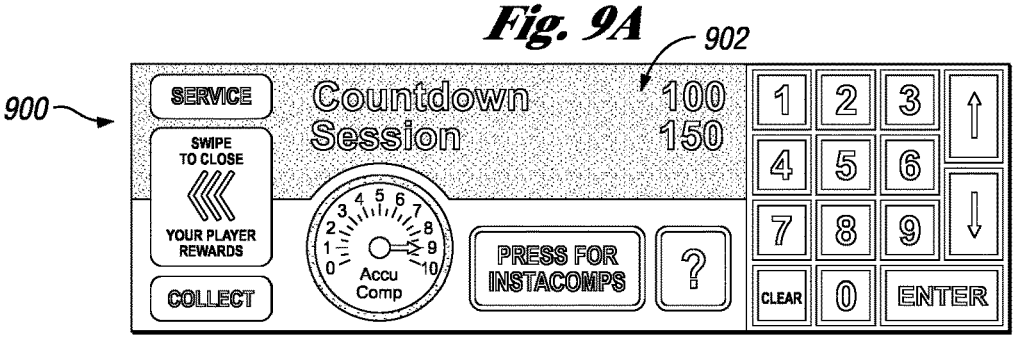
FIG. 9B illustrates the embodiment of the player interface of the button deck display of FIG. 9A with the player tracking and player rewards functionality open.

FIG. 9B illustrates the embodiment of the display 900 of FIG. 9A with the player tracking and player rewards portion 902 of the display open. On many occasions where a particular game does not include buttons on the button deck which are necessary to initiate or play a particular game, it does not matter if the player keeps the player tracking and player rewards screen open or closed as the only button necessary to play is the play button which is separate from the player tracking and player rewards display 902. Of course, any of the embodiments may also contain a play button for player use. On any embodiment, the manufacturer or operator may set which screens a new player will see or utilize when the starting play. Generally, when a player cashes out and removes their player card, it indicates that a player has concluded play on a particular game. Conversely, when a player inserts their player card and/or inserts cash, a voucher, or the like, it signals that a new player is beginning play. In some cases, it may not matter which screen is displayed when a new player initiates play.

As previously described, the player tracking and player rewards screen allows for wide range of functions, many of which are standard in the industry.

Figure 9C:
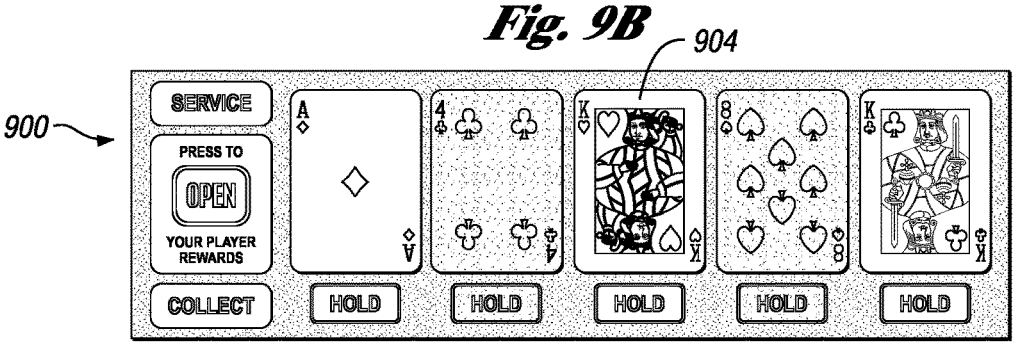
FIG. 9C illustrates another embodiment of the player interface of the button deck display of the present invention with the player tracking and player rewards functionality closed.

FIG. 9C illustrates one embodiment of the display 900 of the present invention with the player tracking and player rewards portion 902 of the display 900 in the closed position. In this embodiment, the game functionality includes icons 904 representing playing cards which can be used for playing video poker. In this case, the base game is draw poker which is well known but one skilled in the art will recognize that any similar card-based game may be played, any number of decks utilized, and even multiple hands may be played. Once a hand of poker is automatically dealt after the player presses the play button, the screen is populated with five playing cards randomly selected from a 52-card deck by the game random number generator (RNG) of the EGM. The player can selectively choose which cards they wish to hold and which they want to discard and subsequently be replaced with new replacement cards determined by the RNG. As illustrated, a player selects the cards they wish to hold by pressing the hold button. If a particular card is not selected, it is greyed out and replaced once the player presses the play button and the game is concluded. Many options exist for indicating which cards the player has chosen to hold. If a player has achieved a winning hand, appropriate credits are added to their credit balance or in the alternative when a winning hand is not achieved, no credits are added and considered a losing hand. In either case of a winning or losing hand the game is then considered concluded and ready for the player to imitate a new game. Generally, the only occasion where a new game cannot immediately be initiated when credits are available for the player to play a new game is when a player has achieved a winning hand with a payout that exceeds $1,200, which is the current IRS threshold for tax reporting, In such cases, the EGM will effectively lock up and prohibit any new game until a slot attendant, in cooperation with the casino cage or slot accounting system, unlocks the game either electronically of physically with a slot key. It is possible to offer configuration options of some EGMs where the slot accounting system may automatically record an IRS reporting threshold win that allows for continuous play or an operator has the ability to configure their own threshold, e.g., a $500 win, if they desire. Once selected or carried over from previous games, the player may proceed to play a new game by pressing the play button 150 on the button deck 144'. The player tracking and player rewards screen is opened by pressing the open button icon or closed by pressing the close button which is displayed once the player tracking and player rewards screen is opened. One skilled in the art will recognized that a wide variety of actions can be used to open or close the player tracking and player rewards screen including gestures, virtual buttons, separate mechanical or electromechanical buttons, etc. As previously discussed, many games do not require any actions during the game once the play button is selected but in the case of games such as skill-based, video poker and the like, player actions may be required during the course of a particular game. Such actions may be accomplished by using the icons, buttons, or the like on the button deck and/or touch screens on the primary game display.

Figure 9D:
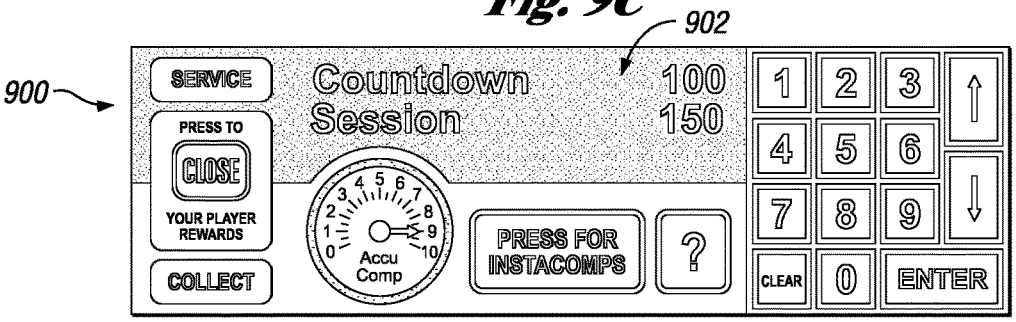
FIG. 9D illustrates the embodiment of the player interface of the button deck display of FIG. 9D with the player tracking and player rewards functionality open.

FIG. 9D illustrates the embodiment of the display 900 of FIG. 9C with the player tracking and player rewards screen of the display 900 open. On many occasions where a particular game does not include buttons on the button deck which are necessary to initiate or play a particular game, it does not matter if the player keeps the player tracking and player rewards screen open or closed as the only button necessary to play is the play button which is separate from the player tracking and player rewards display. Of course, any of the embodiments may also contain one or more play buttons for player use. On any embodiment, the manufacturer or operator may set which screens a new player will see or utilize when the starting play. Generally, when a player cashes out and removes their player card, it indicates that a player has concluded play on a particular game. Conversely, when a player inserts their player card and/or inserts cash, a voucher, or the like, it signals that a new player is beginning play. In some cases, it may not matter which screen is displayed when a new player initiates play while for other game types, it may be preferable to display either the game play display or the player tracking and player rewards screen.

As previously described, the player tracking and player rewards screen allows for wide range of functions, many of which are standard in the industry.

Figure 9E:
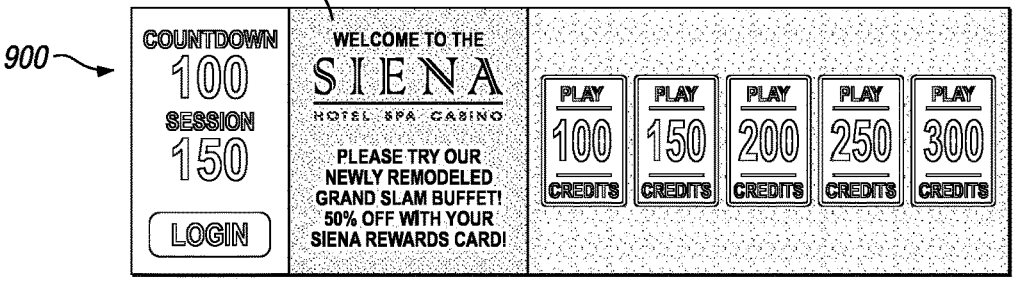
FIG. 9E illustrates another embodiment of the button deck display of the present invention with the player tracking and player rewards functionality appearing together on the display.

FIG. 9E illustrates an embodiment where both the player tracking and player rewards screen 902 and the game play screens appear together on the button deck display 900. As illustrated, the player tracking and player rewards screen may display any number of optional data or messages for the player such as casino advertising 906 as illustrated. Also depicted in FIG. 9E, the display 900 does not include either the collect or service buttons which are not required to be located on the button display 900. Optionally, the button deck may include separate physical, electromechanical, or electronic buttons, such as service or collect, that ae remotely located elsewhere on the button deck.

Figure 10:
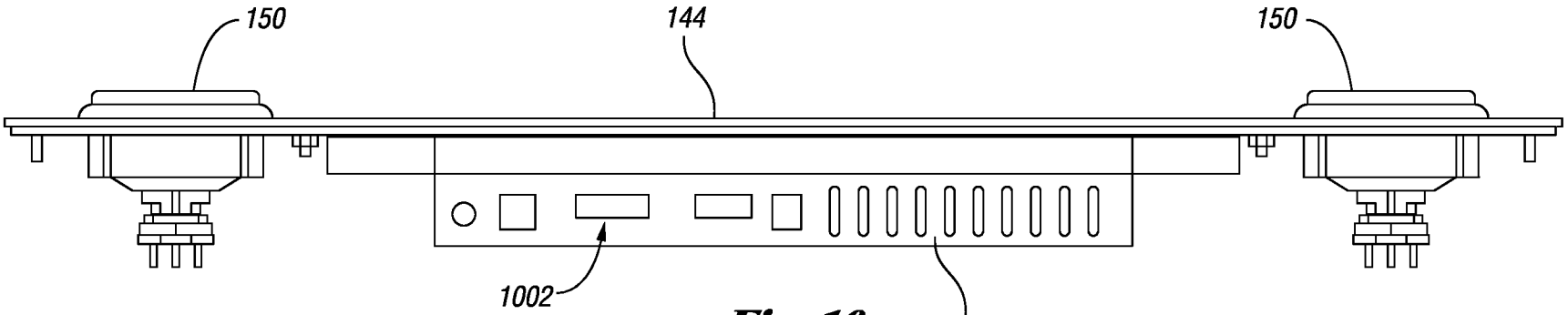
Fig. 10 (Prior Art)
FIG. 10 illustrates a cross section view of a conventional button deck.

FIG. 10 illustrates a cross section view typical digital button deck of a conventional EGM. Button deck 144 is used in conjunction with two play buttons 150. Button deck 144 includes a vented electronics housing 1004 with a plurality on inputs and outputs or other connections 102. Inputs, outputs or other connections such as DC, DP, DVI, USB, RS232 or any other connections may be included.

Figure 11:
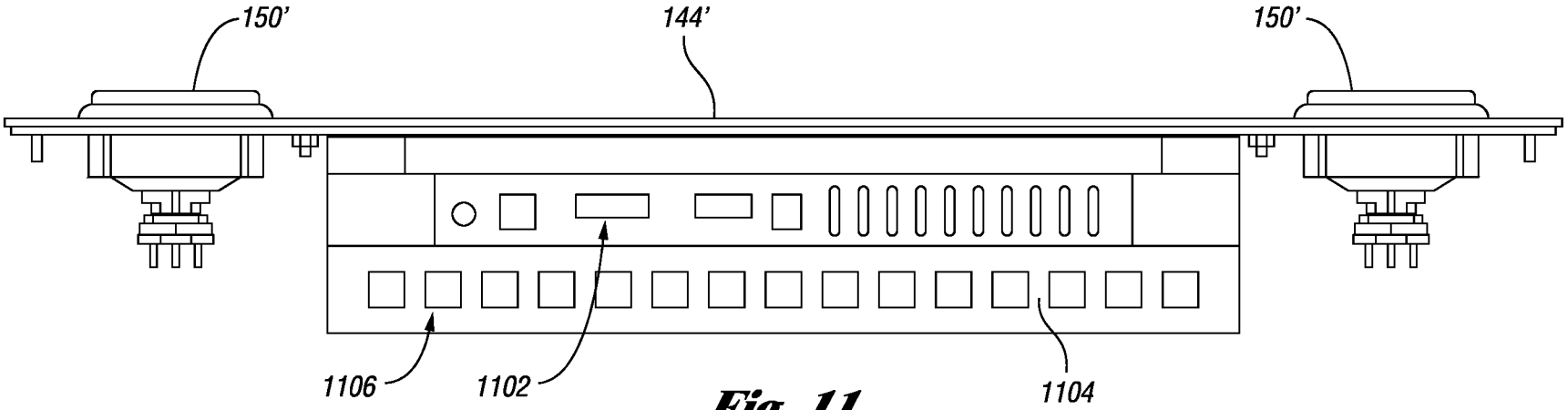
FIG. 11 illustrates a cross section view of the button deck according to the embodiments of the present invention.

FIG. 11 illustrates a cross section view of the present invention of the EGM button deck 144' is used in conjunction with two play buttons 150'. Button deck 144' includes a vented electronics housing 11004 with a plurality on inputs and outputs or other connections. Inputs, outputs or other connections such as DC, DP, DVI, USB, RS232 or any other connections 1102 may be included for general game play functions while the player tracking and player services portion of the module may include connections such as USB, Panel LCD, ethernet 1, ethernet 2, display port 1, display port 2, power, com 1, com 2, com 3, audio out, mic in, SAS serial port 1, SAS serial port 2, LAN, RS232 or any other connections 1106, shown schematically, may be included for player tracking and player services functions. One skilled in the art will recognize that depending on the specific design of the digital button display device incorporating player tracking capabilities other inputs or outputs may be utilized than those listed above. A means for player identification cooperates with the player tracking and player services module and displays appropriate information for the specific player. Such identification means may include a magnetic card reader, card scanner, a cell phone using blue tooth or near field communication, iris scanner, fingerprint scanner, facial recognition, etc. Any of these may be mounted directly on the button deck or located remotely on the peripheral deck or elsewhere on the EGM. In some cases, if electronic funds are utilized to add or cash out credits to a machine, it too may provide appropriate player identification.

One skilled in the art will recognize the advantages of this system which include decreasing the system processing requirements and graphics card requirements by eliminating a display, increasing the functionality and utility of player tracking and players rewards functions as the display is remarkably larger than the prior art, decreasing possible adverse orthopedic effects on many plays, significantly decreasing overall cost of the EGM through the elimination of a display and associated hardware, shortening the EGM height itself, combining of components, etc. Yet another advantage is realized with a shorter height EGM. Current large portrait monitor EGMs significantly reduce the players view looking across the casino floor which has always been viewed positively by operators and players alike. In many casinos, players find themselves in a virtual cave where they cannot see past the EGM banks on the left and right. This even may lead to players getting literally lost when they try to return to their chosen machine after using the restroom, visiting the casino cage, or using an ATM.

Figure 12:
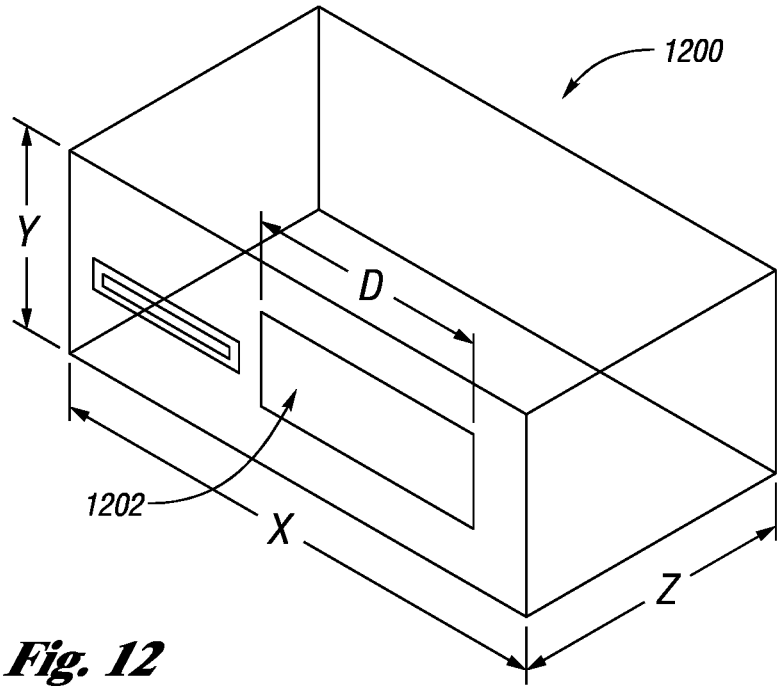
Fig. 12 (Prior Art)
FIG. 12 illustrates a schematic representation of the dimensional quantities of the design envelope of a prior art player tracking module.

FIG. 12 illustrates a schematic representation of a prior art player tracking module design envelope 1200. The X, Y and Z dimensions are generally governed by available space on the peripheral deck of the EGM. This is due to the normal peripheral arrangement of a printer on one side of the player tracking module and a bill validator on the opposite side which defines the maximum X dimension which is generally less than 12', the height of the peripheral deck which defines the Y dimension which is generally less than 5" and the depth of the player tracking module components, generally including a magnetic card reader or similar player identification means which defines the Z dimension which may exceed 6". In many EGMs, there is ample room to extend the Z dimension as it resides in the interior of the EGM cabinet. Dimension D defines the width of the display which in many cases is 6.2" or smaller. The display area 1202 of the prior art player tracking module design envelope 1200 is illustrated and generally is limited to 6.2" width on the x-axis and 2.325" high on the y-axis.

Figure 13:
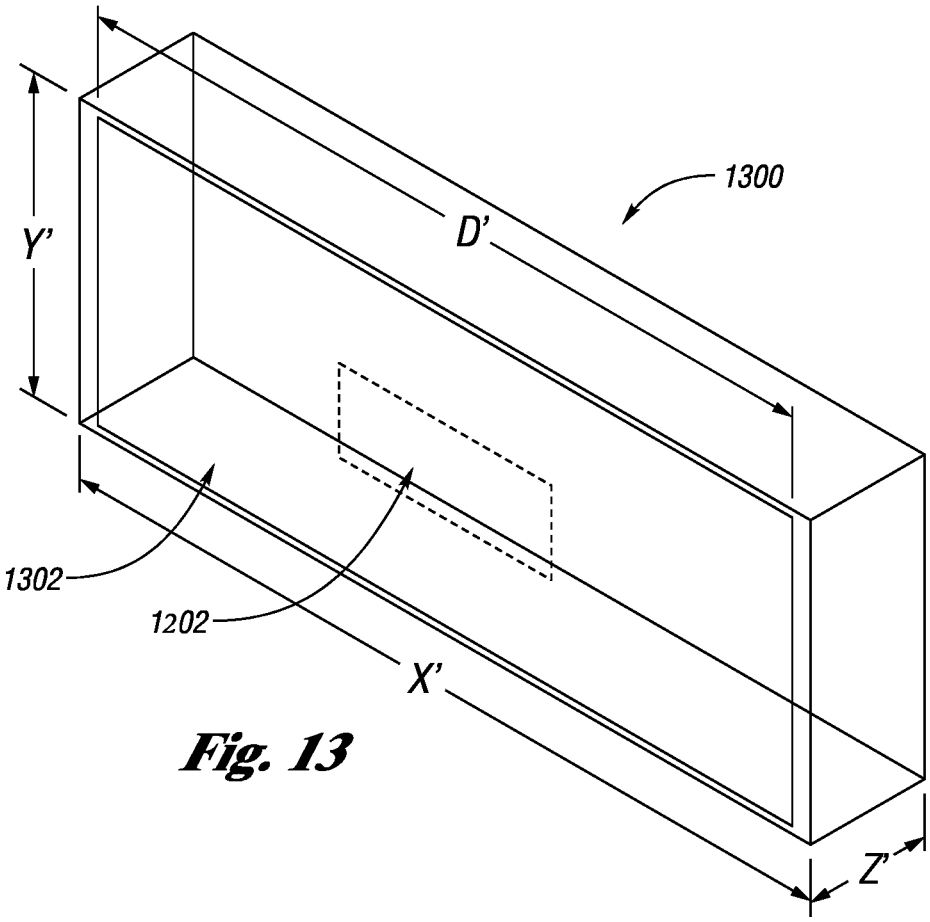
FIG. 13 illustrates a schematic representation of the dimensional quantities of the design envelope according to the embodiments of the present invention.

FIG. 13 illustrates a schematic representation of the digital button display device incorporating player tracking capabilities of the present invention. The design envelope 1200 of FIG. 12 is to approximate scale of design envelope 1300 of FIG. 13. The width X' of the digital button display device incorporating player tracking capabilities is only confined by the play buttons, if they exist, and is shown as approximately 19". The height of the digital button display device incorporating player tracking capabilities is preferably approximately 5" but may be made considerably larger, however the depth of the digital button display device incorporating player tracking capabilities may be restricted due to the thickness of the button deck which is generally less than 4". Therefore, the depth Z' is generally confined to a dimension of approximately 3.0" or less. Display dimension D' can be greatly increased, relative to the prior art, and may exceed 19" which is conducive to more extensive messaging, easier player navigation and player input. The display area 1302 of the player tracking module design envelope of the present invention 1300 is illustrated and generally may be as large as 19" width on the x-axis and 16" high on the y-axis. As illustrated, the display area 1302 is considerably larger than the prior art display area 1202 shown in broken line resulting in a display capable of displaying far more information than the prior art as the display area may be as much as 20 times larger in surface area than the prior art. Such increased display area allows for the desired game play functionality along with easier reading, increased functionality on a single screen, the addition of such things as enhanced player interface functions, secondary games, displaying television shows, Facebook and similar interactivity, updates on wait times for a buffet or restaurant, local weather, news programing, show information, casino promotions, advertisements, property videos, etc.

Accordingly, the digital button display device incorporating player tracking capabilities of the present invention may be manufactured within certain confines yet results in a greatly improved player functionality due to the ability to significantly increased the display size while at the same time incorporating full game play functionalities. As shown, the design envelope is developed for a particular type EGM, known as a hybrid or slant type machine but the present invention is adaptable to any type EGM including upright EGMs and bar top EGMs which will have differing design envelopes but enjoy many or all of the same benefits of the design envelope illustrated.

Although the invention has been described in detail with reference to several embodiments, additional variations and modifications exist within the scope and spirit of the invention as described and defined in the following claims.

We claim:

1. A system comprising:

a gaming device comprising:

a primary game display;

a monetary input device configured to receive a physical item associated with a monetary value;

a user interface configured to: enable a player to select a wager for a game of chance, and enable the player to initiate a cash out operation;

a processor programmed to:

add the monetary value to a credit balance for the player;

deduct the selected wager from the credit balance;

decrease the credit balance in response to the cash out operation;

a digital button deck device incorporating player tracking capabilities and game play functionality via a digital button deck display, said digital button deck display device adapted to at least partially shift between one or more player rewards screens and one or more game play functionality screens; and wherein said processor is programmed to (i) responsive to player inputs, partially shift between one or more player rewards screens and one or more game play functionality screens and (ii) based on game play requirements, automatically partially shift between one or more player rewards screens and one or more game play functionality screens.

2. The system of claim 1 wherein the digital button deck display is a touch screen display.

3. The system of claim 1 wherein the identity of the player is determined based on a player reward card which is inserted into a magnetic card reader.

4. The system of claim 3 wherein the magnetic card reader is remotely located from the digital button display device incorporating player tracking capabilities and game play functionality.

5. The system of claim 1 wherein the identity of the player is determined based on a communication with a player cellular telephone.

6. The system of claim 1 wherein the digital button deck display is configured to accept player instructions inputted by the player.

7. The system of claim 1 wherein the digital button deck display is configured to accept game play instructions inputted by the player.

8. The system of claim 1 wherein the digital button deck display is configured to accept cashless wagering instructions inputted by the player.

9. The system of claim 1 wherein the digital button deck display is configured to accept automated funds transfer instructions inputted by the player.

10. The system of claim 1 wherein the digital button display device incorporating player tracking capabilities and game play functionality includes one or more separate device modules.

11. The system of claim 1 wherein the digital button display device incorporating player tracking capabilities and game play functionality includes interoperability functionality to cooperate and communicate with differing slot accounting systems.

12. The system of claim 1 wherein the digital button display device is positioned in a space no larger than about 19 inches wide but larger than about 9" wide, no larger than about 16 inches high but larger than about 3" high and no larger than about 3 inches deep.

13. A system comprising:

a gaming device including:

a primary game display;

a monetary input device configured to receive a physical item associated with a monetary value;

a user interface configured to: enable a player to select a wager for a game of chance, and enable the player to initiate a cash out operation;

a processor programmed to:

add the monetary value to a credit balance for the player;

deduct the selected wager from the credit balance;

decrease the credit balance in response to the cash out operation;

the user interface integrated into a digital button deck display device, the digital button deck display device including a display, player tracking functionality and game play functionality, said digital button deck display device adapted to select between one or more player tracking rewards screens and one or more game play functionality screens; and wherein said processor is programmed to (i) responsive to player inputs, select between one or more player tracking rewards screens and one or more game play functionality screens and (ii) based on game play requirements, automatically select between one or more player tracking rewards screens and one or more game play functionality screens, wherein in either instance, game play functionality screens depict, at least partially, player tracking rewards information.

14. The system of claim 13 wherein the digital button deck display is a touch screen display.

15. The system of claim 13 wherein the identity of the player is determined based on a player reward card which is inserted into a magnetic card reader.

16. The system of claim 15 wherein the magnetic card reader is remotely located from the digital button display device incorporating player tracking capabilities and game play functionality.

17. The system of claim 13 wherein the identity of the player is determined based on a communication with a player cellular telephone.

18. The system of claim 13 wherein the digital button deck display is configured to accept player instructions inputted by the player.

19. The system of claim 13 wherein the digital button deck display is configured to accept game play instructions inputted by the player.

20. The system of claim 13 wherein the digital button deck display is configured to accept cashless wagering instructions inputted by the player.

21. The system of claim 13 wherein the digital button deck display is configured to accept automated funds transfer instructions inputted by the player.

22. The system of claim 13 wherein the digital button display device incorporating player tracking capabilities and game play functionality includes one or more separate device modules.

23. The system of claim 13 wherein the digital button display device incorporating player tracking capabilities and game play functionality includes interoperability functionality to cooperate and communicate with differing slot accounting systems.

24. The system of claim 13 wherein the digital button display device is positioned in a space no larger than about 19 inches wide but larger than about 9" wide, no larger than about 16 inches high but larger than about 3" high and no larger than about 3 inches deep.

25. A gaming device comprising:

a monetary input device configured to receive a physical item associated with a monetary value;

a user interface configured to: enable a player to select a wager for a game of chance, and enable the player to initiate a cash out operation;

a processor programmed to:

add the monetary value to a credit balance for the player;

deduct the selected wager from the credit balance;

decrease the credit balance in response to the cash out operation;

a primary game display;

a peripheral deck positioned below the primary game display, the peripheral deck including a card reader, printer and cash acceptor but no player tracking interface; and a digital button deck display device positioned below the peripheral deck, the digital button deck display device including a display, player tracking interface and game play interface, said digital button deck display device adapted to select between one or more player tracking rewards screens and one or more game play functionality screens; and wherein said processor is programmed to (i) responsive to player inputs, select between one or more player tracking rewards screens and one or more game play functionality screens and (ii) based on game play requirements, automatically select between one or more player tracking rewards screens and one or more game play functionality screens, wherein in either instance, game play functionality screens depict, at least partially, player tracking rewards information.

26. The system of claim 25 wherein the digital button deck display is a touch screen display.

27. The system of claim 25 wherein the identity of the player is determined based on a player reward card which is inserted into a magnetic card reader.

28. The system of claim 27 wherein the magnetic card reader is remotely located from the digital button display device incorporating player tracking capabilities and game play functionality.

29. The system of claim 25 wherein the identity of the player is determined based on a communication with a player cellular telephone.

30. The system of claim 25 wherein the digital button deck display is configured to accept player instructions inputted by the player.

31. The system of claim 25 wherein the digital button deck display is configured to accept game play instructions inputted by the player.

32. The system of claim 25 wherein the digital button deck display is configured to accept cashless wagering instructions inputted by the player.

33. The system of claim 25 wherein the digital button deck display is configured to accept automated funds transfer instructions inputted by the player.

34. The system of claim 25 wherein the digital button display device incorporating player tracking capabilities and game play functionality includes one or more separate device modules.

35. The system of claim 25 wherein the digital button display device incorporating player tracking capabilities and game play functionality includes interoperability functionality to cooperate and communicate with differing slot accounting systems.

36. The system of claim 25 wherein the digital button display device is positioned in a space no larger than about 19 inches wide but larger than about 9" wide, no larger than about 16 inches high but larger than about 3" high and no larger than about 3 inches deep.

37. A method of creating a gaming device interface comprising:

maintaining the primary game display in a housing;

utilizing the primary game display to present a video-based game;

positioning a peripheral deck below the primary game display in the housing;

utilizing the peripheral deck to support a card reader, printer and cash acceptor without a player tracking interface; and positioning a digital button display device below the peripheral deck, the digital button deck display device having a digital button deck display;

configuring the digital button deck display to switch between one or more player tracking rewards screens and one or more game play functionality screens; and configuring said processor to (i) responsive to player inputs, partially shift between one or more player tracking rewards screens and one or more game play functionality screens and (ii) based on game play requirements, automatically partially shift between one or more player tracking rewards screens and one or more game play functionality screens.

38. The method of claim 37 further comprising configuring the digital button deck display to switch between the one or more player tracking screens and the one or more game play screens responsive to a player swiping a portion of the digital button deck display.

39. The method of claim 37 wherein the primary game display is comprised of two or more separate displays.

40. The method of claim 37 further comprising configuring the digital button deck display to switch between the one or more player tracking screens and the one or more game play screens responsive to a player making one or more hand gestures.

41. The method of claim 37 wherein the digital button display device is positioned in a space no larger than about 19 inches wide but larger than about 9" wide, no larger than about 16 inches high but larger than about 3" high and no larger than about 3 inches deep.

42. A system comprising:

a gaming device comprising:

a primary game display;

a monetary input device configured to receive a physical item associated with a monetary value;

a user interface configured to: enable a player to select a wager for a game of chance, and enable the player to initiate a cash out operation; a processor programmed to:

add the monetary value to a credit balance for the player;

deduct the selected wager from the credit balance;

decrease the credit balance in response to the cash out operation;

a digital button deck device incorporating player tracking capabilities and game play functionality via a digital button deck display, said digital button deck display device adapted to at least partially shift between one or more player rewards screens and one or more game play functionality screens; and wherein said processor is programmed to (i) responsive to player inputs, partially shift between one or more player rewards screens and one or more game play functionality screens and (ii) based on game play requirements, automatically partially shift between one or more player rewards screens and one or more game play functionality screens.

43. The system of claim 42 wherein the digital button deck display is a touch screen display.

44. The system of claim 42 wherein the identity of the player is determined based on a player reward card which is inserted into a magnetic card reader.

45. The system of claim 44 wherein the magnetic card reader is remotely located from the digital button display device incorporating player tracking capabilities and game play functionality.

46. The system of claim 43 wherein the identity of the player is determined based on a communication with a player cellular telephone.

47. The system of claim 43 wherein the digital button deck display is configured to accept player instructions inputted by the player.

48. The system of claim 43 wherein the digital button deck display is configured to accept game play instructions inputted by the player.

49. The system of claim 43 wherein the digital button deck display is configured to accept cashless wagering instructions inputted by the player.

50. The system of claim 43 wherein the digital button deck display is configured to accept automated funds transfer instructions inputted by the player.

51. The system of claim 43 wherein the digital button display device incorporating player tracking capabilities and game play functionality includes one or more separate device modules.

52. The system of claim 43 wherein the digital button display device incorporating player tracking capabilities and game play functionality includes interoperability functionality to cooperate and communicate with differing slot accounting systems.

53. The system of claim 43 wherein the digital button display device is positioned in a space no larger than about 19 inches wide but larger than about 9" wide, no larger than about 16 inches high but larger than about 3" high and no larger than about 3 inches deep.

54. A system comprising: a gaming device including:

a primary game display;

a monetary input device configured to receive a physical item associated with a monetary value;

a user interface configured to: enable a player to select a wager for a game of chance, and enable the player to initiate a cash out operation;

a processor programmed to:

add the monetary value to a credit balance for the player;

deduct the selected wager from the credit balance;

decrease the credit balance in response to the cash out operation;

the user interface integrated into a digital button deck display device, the digital button deck display device including a display, player tracking functionality and game play functionality, said digital button deck display device adapted to select between one or more player tracking rewards screens and one or more game play functionality screens; and wherein said processor is programmed to (i) responsive to player inputs, select between one or more player tracking rewards screens and one or more game play functionality screens and (ii) based on game play requirements, automatically select between one or more player tracking rewards screens and one or more game play functionality screens, wherein in either instance, game play functionality screens depict, at least partially, player tracking rewards information.

55. The system of claim 54 wherein the digital button deck display is a touch screen display.

56. The system of claim 54 wherein the identity of the player is determined based on a player reward card which is inserted into a magnetic card reader.

57. The system of claim 56 wherein the magnetic card reader is remotely located from the digital button display device incorporating player tracking capabilities and game play functionality.

58. The system of claim 56 wherein the identity of the player is determined based on a communication with a player cellular telephone.

59. The system of claim 56 wherein the digital button deck display is configured to accept player instructions inputted by the player.

60. The system of claim 56 wherein the digital button deck display is configured to accept game play instructions inputted by the player.

61. The system of claim 56 wherein the digital button deck display is configured to accept cashless wagering instructions inputted by the player.

62. The system of claim 56 wherein the digital button deck display is configured to accept automated funds transfer instructions inputted by the player.

63. The system of claim 56 wherein the digital button display device incorporating player tracking capabilities and game play functionality includes one or more separate device modules.

64. The system of claim 56 wherein the digital button display device incorporating player tracking capabilities and game play functionality includes interoperability functionality to cooperate and communicate with differing slot accounting systems.

65. The system of claim 56 wherein the digital button display device is positioned in a space no larger than about 19 inches wide but larger than about 9" wide, no larger than about 16 inches high but larger than about 3" high and no larger than about 3 inches deep.

66. A gaming device comprising:

a monetary input device configured to receive a physical item associated with a monetary value;

a user interface configured to: enable a player to select a wager for a game of chance, and enable the player to initiate a cash out operation;

a processor programmed to:

add the monetary value to a credit balance for the player;

deduct the selected wager from the credit balance;

decrease the credit balance in response to the cash out operation;

a primary game display;

a peripheral deck positioned below the primary game display, the peripheral deck including a card reader, printer and cash acceptor but no player tracking interface;

a digital button deck display device positioned below the peripheral deck, the digital button deck display device including a display, player tracking interface and game play interface, said digital button deck display device adapted to select between one or more player tracking rewards screens and one or more game play functionality screens; and wherein said processor is programmed to (i) responsive to player inputs, select between one or more player tracking rewards screens and one or more game play functionality screens and (ii) based on game play requirements, automatically select between one or more player tracking rewards screens and one or more game play functionality screens, wherein in either instance, game play functionality screens depict, at least partially, player tracking rewards information.

67. The gaming device of claim 66 wherein the digital button deck display is a touch screen display.

68. The gaming device of claim 66 wherein the identity of the player is determined based on a player reward card which is inserted into a magnetic card reader.

69. The gaming device of claim 68 wherein the magnetic card reader is remotely located from the digital button display device incorporating player tracking capabilities and game play functionality.

70. The gaming device of claim 66 wherein the identity of the player is determined based on a communication with a player cellular telephone.

71. The gaming device of claim 66 wherein the digital button deck display is configured to accept player instructions inputted by the player.

72. The gaming device of claim 66 wherein the digital button deck display is configured to accept game play instructions inputted by the player.

73. The gaming device of claim 66 wherein the digital button deck display is configured to accept cashless wagering instructions inputted by the player.

74. The gaming device of claim 66 wherein the digital button deck display is configured to accept automated funds transfer instructions inputted by the player.

75. The gaming device of claim 66 wherein the digital button display device incorporating player tracking capabilities and game play functionality includes one or more separate device modules.

76. The gaming device of claim 66 wherein the digital button display device incorporating player tracking capabilities and game play functionality includes interoperability functionality to cooperate and communicate with differing slot accounting systems.

77. The gaming device of claim 66 wherein the digital button display device is positioned in a space no larger than about 19 inches wide but larger than about 9" wide, no larger than about 16 inches high but larger than about 3" high and no larger than about 3 inches deep.

78. A method of creating a gaming device interface comprising: maintaining the primary game display in a housing;

utilizing the primary game display to present a video-based game;

positioning a peripheral deck below the primary game display in the housing;

utilizing the peripheral deck to support a card reader, printer and cash acceptor without a player tracking interface; and positioning a digital button display device below the peripheral deck, the digital button display device having a digital button deck display;

configuring the digital button deck display to switch between one or more player tracking rewards screens and one or more game play functionality screens; and configuring said processor to (i) responsive to player inputs, partially shift between one or more player tracking rewards screens and one or more game play functionality screens and (ii) based on game play requirements, automatically partially shift between one or more player tracking rewards screens and one or more game play functionality screens.

79. The method of claim 78 further comprising configuring the digital button deck display to switch between the one or more player tracking screens and the one or more games play screens responsive to a player swiping a portion of the digital button deck display.

80. The method of claim 78 wherein the primary game display is comprised of two or more separate displays.

81. The method of claim 78 further comprising configuring the digital button deck display to switch between the one or more player tracking screens and the one or more games play screens responsive to a player making one or more hand gestures.

82. The method of claim 78 wherein the digital button display device is positioned in a space no larger than about 19 inches wide but larger than about 9" wide, no larger than about 16 inches high but larger than about 3" high and no larger than about 3 inches deep.

* * * * *